US009343074B2

(12) United States Patent
Disch et al.

(10) Patent No.: US 9,343,074 B2
(45) Date of Patent: May 17, 2016

(54) APPARATUS AND METHOD FOR AUDIO ENCODING AND DECODING EMPLOYING SINUSOIDAL SUBSTITUTION

(71) Applicant: FRAUNHOFER-GESELLSCHAFT ZUR FOERDERUNG DER ANGEWANDTEN FORSCHUNG E.V., Munich (DE)

(72) Inventors: Sascha Disch, Fuerth (DE); Benjamin Schubert, Nuremberg (DE); Ralf Geiger, Erlangen (DE); Martin Dietz, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 167 days.

(21) Appl. No.: 14/078,468

(22) Filed: Nov. 12, 2013

(65) Prior Publication Data

US 2014/0074486 A1 Mar. 13, 2014

Related U.S. Application Data

(63) Continuation of application No. PCT/EP2012/076746, filed on Dec. 21, 2012.

(60) Provisional application No. 61/588,998, filed on Jan. 20, 2012.

(51) Int. Cl.

| | |
|---|---|
| ***G10L 19/00*** | (2013.01) |
| ***G10L 19/02*** | (2013.01) |
| ***G10L 19/032*** | (2013.01) |

(52) U.S. Cl.

CPC ..... *G10L 19/02* (2013.01); *G10L 19/032* (2013.01)

(58) Field of Classification Search

CPC . G10L 19/0212; G10L 19/008; G10L 19/022; G10L 19/093; G10L 19/12; H04N 21/2385; H04N 21/242; H04N 5/211; H04N 5/46; H04N 7/17309; H03B 28/00; H04L 2025/03414; H04L 5/0016; H04L 5/06

USPC ..... 704/500, 503, 501, 219, 203; 600/515; 455/313, 126; 375/216, 147; 370/497, 370/441, 343; 348/725, 614

See application file for complete search history.

(56) References Cited

U.S. PATENT DOCUMENTS 4,686,570 A * 8/1987 Lewis, Jr. ..... H04N 5/211 348/614
4,703,357 A * 10/1987 Ng ..... H04N 5/211 348/611

(Continued)

FOREIGN PATENT DOCUMENTS

CA 2821036 A1 9/2009
CN 1424713 A 6/2003

(Continued)

OTHER PUBLICATIONS

Bartkowiak, "A Complex Envelope Sinusoidal Model for Audio Coding", 2007, Chair of Multimedia Telecommunications and Microelectronics, Poznań University of Technology, 10th Int conferece, all pages.*

(Continued)

*Primary Examiner* — Michael Colucci
(74) *Attorney, Agent, or Firm* — Perkins Coie LLP; Michael A. Glenn

(57) ABSTRACT

An apparatus for generating an audio output signal based on an encoded audio signal spectrum has a processing unit, a pseudo coefficients determiner, a spectrum modification unit, a spectrum-time conversion unit, a controllable oscillator and a mixer. The pseudo coefficients determiner is configured to determine pseudo coefficients of the decoded audio signal spectrum. The spectrum modification unit is configured to set the pseudo coefficients to a predefined value to acquire a modified audio signal spectrum. The spectrum-time conversion unit is configured to convert the modified audio signal spectrum to a time-domain. The controllable oscillator is configured to generate a time-domain oscillator signal and is controlled by the spectral location and the spectral value of at least one of the pseudo coefficients. The mixer is configured to mix the time-domain conversion signal and the time-domain oscillator signal.

32 Claims, 6 Drawing Sheets

(56) References Cited

U.S. PATENT DOCUMENTS

| | | | | |
|---|---|---|---|---|
| 4,896,320 | A * | 1/1990 | Gockler | H03H 17/0266 370/497 |
| 5,278,837 | A * | 1/1994 | Kelley | H03D 7/16 370/343 |
| 5,418,815 | A * | 5/1995 | Ishikawa | H04N 21/42638 348/E5.108 |
| 5,560,367 | A * | 10/1996 | Haardt | A61B 5/04007 600/515 |
| 5,640,416 | A * | 6/1997 | Chalmers | H04B 1/7085 375/147 |
| 6,266,644 | B1 * | 7/2001 | Levine | G10L 19/20 704/200.1 |
| 6,356,555 | B1 * | 3/2002 | Rakib | H03M 13/256 348/E7.07 |
| 6,665,638 | B1 | 12/2003 | Kang et al. | |
| 6,760,078 | B2 * | 7/2004 | Limberg | H03J 7/02 348/470 |
| 7,058,571 | B2 | 6/2006 | Tsushima et al. | |
| 2004/0083110 | A1 * | 4/2004 | Wang | G10L 19/005 704/500 |
| 2004/0088160 | A1 * | 5/2004 | Manu | G10L 19/022 704/203 |
| 2004/0203542 | A1 * | 10/2004 | Seo | H03F 1/3247 455/126 |
| 2005/0177360 | A1 | 8/2005 | Schuijers et al. | |
| 2006/0210180 | A1 | 9/2006 | Geiger et al. | |
| 2006/0281429 | A1 * | 12/2006 | Kishi | H04B 1/30 455/313 |
| 2008/0169142 | A1 | 7/2008 | Kinoshita | |
| 2009/0125314 | A1 * | 5/2009 | Hellmuth | G10L 19/008 704/501 |
| 2009/0222261 | A1 | 9/2009 | Jung et al. | |
| 2009/0234644 | A1 * | 9/2009 | Reznik | G10L 19/24 704/203 |
| 2009/0281812 | A1 | 11/2009 | Jung et al. | |
| 2010/0177903 | A1 | 7/2010 | Vinton et al. | |
| 2010/0292986 | A1 * | 11/2010 | Vasilache | G10L 19/038 704/219 |
| 2011/0054885 | A1 | 3/2011 | Nagel et al. | |
| 2011/0076569 | A1 | 3/2011 | Kimura | |
| 2012/0212375 | A1 * | 8/2012 | Depree, IV | H01Q 15/0086 343/700 MS |
| 2013/0013321 | A1 * | 1/2013 | Oh | G10L 21/038 704/500 |

FOREIGN PATENT DOCUMENTS

| | | | |
|---|---|---|---|
| DE | 102008015702 | A1 | 8/2009 |
| EP | 1895511 | A1 | 3/2008 |
| EP | 2333960 | A1 | 6/2011 |
| JP | S62-502572 | | 10/1987 |
| JP | 2002-182695 | | 6/2002 |
| JP | 2005-520217 | | 7/2005 |
| JP | 2007-334261 | | 12/2007 |
| JP | 2011-514562 | | 5/2011 |
| RU | 2325046 | | 5/2008 |
| RU | 2325708 | | 5/2008 |
| RU | 2422922 | C1 | 6/2011 |
| TW | 200746052 | A | 12/2007 |
| TW | 200939211 | | 9/2009 |
| WO | WO-86/05617 | | 9/1986 |
| WO | WO 2008/082165 | | 7/2008 |
| WO | 2011021845 | A3 | 6/2011 |

OTHER PUBLICATIONS

ISO/IEC 14496-3:2009(E)—Information technology—Coding of audio-visual objects—Part 3: Audio, Subpart 4, 2009.

"http://people.xiph.org/~xiphmont/demo/ghost/demo.html", The corresponding archive.org-website is stored at: http://web.archive.org/web/20110121141149/http://people.xiph.org/~xiphmont/demo/ghost/demo.html, Copyright 2011, 3 pages.

Bessette, B et al., "Universal speech/audio coding using hybrid ACELP/TCX techniques", Proceedings of ICASSP '05, IEEE International Conference on Acoustics, Speech, and Signal Processing, Mar. 18-23, 2005, pp. 301-304.

Daudet, L et al., "MDCT analysis of sinusoids: exact results and applications to coding artifacts reduction", Speech and Audio Processing, IEEE Transactions on, vol. 12, No. 3, May 2004, pp. 302-312.

Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., Oct. 2001, pp. 51-54.

Purnhagen, H et al., "HILN'the MPEG-4 parametric audio coding tools", Proceedings ISCAS 2000 Geneva, The 2000 IEEE International Symposium on Circuits and Systems, 2000, pp. 201-204.

Schuijers, E et al., "Advances in Parametrie Coding for High-Quality Audio", Audio Engineering Society Convention 114, preprint, Amsterdam/NL, Mar. 22-25, 2003, pp. 1-11.

Van Schijndel, NH et al., "Rate-distortion optimized hybrid sound coding", 2005 IEEE Workshop on Applications of Signal Processing to Audio and Acoustics, Oct. 16-19, 2005, pp. 235-238.

* cited by examiner

APPARATUS AND METHOD FOR AUDIO ENCODING AND DECODING EMPLOYING SINUSOIDAL SUBSTITUTION

CROSS-REFERENCE TO RELATED APPLICATIONS

This application is a continuation of copending International Application No. PCT/EP2012/076746, filed Dec. 21, 2012, which is incorporated herein by reference in its entirety, and additionally claims priority from U.S. Application No. 61/588,998, filed Jan. 20, 2012, which is also incorporated herein by reference in its entirety.

The present invention relates to audio signal encoding, decoding and processing, and, in particular, to audio encoding and decoding employing sinusoidal substitution.

BACKGROUND OF THE INVENTION

Audio signal processing becomes more and more important. Challenges arise, as modern perceptual audio codecs are expected to deliver satisfactory audio quality at increasingly low bit rates. Additionally, often the permissible latency is also very low, e.g. for bi-directional communication applications or distributed gaming etc.

Modern audio codecs, like e.g. USAC (Unified Speech and Audio Coding), often switch between time domain predictive coding and transform domain coding, nevertheless music content is still predominantly coded in the transform domain. At low bit rates, e.g. <14 kbit/s, tonal components in music items often sound bad when coded through transform coders, which makes the task of coding audio at sufficient quality even more challenging.

Additionally, low-delay constraints generally lead to a suboptimal frequency response of the transform coder's filter bank (due to low-delay optimized window shape and/or transform length) and therefore further compromise the perceptual quality of such codecs.

According to the classic psychoacoustic model, pre-requisites for transparency with respect to quantization noise are defined. At high bit rates, this relates to a perceptually adapted optimal time/frequency distribution of quantization noise that obeys the human auditory masking levels. At low bit rates, however, transparency cannot be reached. Therefore, a masking level requirements reduction strategy may be employed at low bit rates.

Already, top-notch codecs have been provided for music content, in particular, transform coders based on the Modified Discrete Cosine Transform (MDCT), which quantize and transmit spectral coefficients in the frequency domain. However, at very low data rates, only very few spectral lines of each time frame can be coded by the available bits for that frame. As a consequence, temporal modulation artifacts and so-called warbling artifacts are inevitably introduced into the coded signal.

Most prominently, these types of artifacts are perceived in quasi-stationary tonal components. This happens especially if, due to delay constraints, a transform window shape has to be chosen that induces significant crosstalk between adjacent spectral coefficients (spectral broadening) due to the well-known leakage effect. However, nonetheless usually only one or few of these adjacent spectral coefficients remain non-zero after the coarse quantization by the low-bit rate coder.

As stated above, in conventional technology, according to one approach, transform coders are employed. Contemporary high compression ratio audio codecs that are well-suited for coding of music content all rely on transform coding. Most prominent examples are MPEG2/4 Advanced Audio Coding (AAC) and MPEG-D Unified Speech and Audio Coding (USAC). USAC has a switched core consistent of an Algebraic Code Excited Linear Prediction (ACELP) module plus a Transform Coded Excitation (TCX) module (see [5]) intended mainly for speech coding and, alternatively, AAC mainly intended for coding of music. Like AAC, also TCX is a transform based coding method. At low bit rate settings, these coding schemes are prone to exhibit warbling artifacts, especially if the underlying coding schemes are based on the Modified Discrete Cosine Transform (MDCT) (see [1]).

For music reproduction, transform coders are the advantageous technique for audio data compression. However, at low bit rates, traditional transform coders exhibit strong warbling and roughness artifacts. Most of the artifacts originate from too sparsely coded tonal spectral components. This happens especially if these are spectrally smeared by a suboptimal spectral transfer function (leakage effect) that is mainly designed to meet strict delay constraints.

According to another approach in conventional technology, the coding schemes are fully parametric for transients, sinusoids and noise. In particular, for medium and low bit rates, fully parametric audio codecs have been standardized, the most prominent of which are MPEG-4 Part 3, Subpart 7 Harmonic and Individual Lines plus Noise (HILN) (see [2]) and MPEG-4 Part 3, Subpart 8 SinuSoidal Coding (SSC) (see [3]). Parametric coders, however, suffer from an unpleasantly artificial sound and, with increasing bit rate, do not scale well towards perceptual transparency.

A further approach provides hybrid waveform and parametric coding. In [4], a hybrid of transform based waveform coding and MPEG 4-SSC (sinusoidal part is proposed. In an iterative process, sinusoids are extracted and subtracted from the signal to form a residual signal to be coded by transform coding techniques. The extracted sinusoids are coded by a set of parameters and transmitted alongside with the residual. In [6], a hybrid coding approach is provided that codes sinusoids and residual separately. In [7], at the so-called Constrained Energy Lapped Transform (CELT) codec/Ghost webpage, the idea of utilizing a bank of oscillators for hybrid coding is depictured.

At medium or higher bit rates, transform coders are well-suited for coding of music due to their natural sound. There, the transparency requirements of the underlying psychoacoustic model are fully or almost fully met. However, at low bit rates, coders have to seriously violate the requirements of the psychoacoustic model and in such a situation transform coders are prone to warbling, roughness, and musical noise artifacts.

Although fully parametric audio codecs are most suited for lower bit rates, they are, however, known to sound unpleasantly artificial. Moreover, these codecs do not seamlessly scale to perceptual transparency, since a gradual refinement of the rather coarse parametric model is not feasible.

Hybrid waveform and parametric coding could potentially overcome the limits of the individual approaches and could potentially benefit from the mutual orthogonal properties of both techniques. However, it is, in the current state of the art, hampered by a lack of interplay between the transform coding part and the parametric part of the hybrid codec. Problems relate to signal division between parametric and transform codec part, bit budget steering between transform and parametric part, parameter signalling techniques and seamless merging of parametric and transform codec output.

SUMMARY

According to an embodiment, an apparatus for generating an audio output signal based on an encoded audio signal spectrum may have: a processing unit for processing the encoded audio signal spectrum to acquire a decoded audio signal spectrum the decoded audio signal spectrum having a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients, a pseudo coefficients determiner for determining one or more pseudo coefficients of the decoded audio signal spectrum, each of the pseudo coefficients having a spectral location and a spectral value, a spectrum modification unit for setting the one or more pseudo coefficients to a predefined value to acquire a modified audio signal spectrum, a spectrum-time conversion unit for converting the modified audio signal spectrum to a time-domain to acquire a time-domain conversion signal, a controllable oscillator for generating a time-domain oscillator signal, the controllable oscillator being controlled by the spectral location and the spectral value of at least one of the one or more pseudo coefficients, and a mixer for mixing the time-domain conversion signal and the time-domain oscillator signal to acquire the audio output signal.

According to another embodiment, an apparatus for encoding an audio signal input spectrum of an audio signal, the audio signal input spectrum having a plurality of spectral coefficients, wherein each of the spectral coefficients has a spectral location within the audio signal input spectrum, a spectral value, wherein the spectral coefficients are sequentially ordered according to their spectral location within the audio signal input spectrum so that the spectral coefficients form a sequence of spectral coefficients, wherein each of the spectral coefficients has at least one of one or more predecessors and one or more successors, wherein the each of the predecessors of said spectral coefficient is one of the spectral coefficients that precedes said spectral coefficient within the sequence, wherein each of the successors of said spectral coefficient is one of the spectral coefficients that succeeds said spectral coefficient within the sequence, and wherein the apparatus may have: an extrema determiner for determining one or more extremum coefficients, a spectrum modifier for modifying the audio signal input spectrum to acquire a modified audio signal spectrum by setting the spectral value of at least one of the predecessors or at least one of the successors of at least one of the extremum coefficients to a predefined value, wherein the spectrum modifier is configured to not set the spectral values of the one or more extremum coefficients to the predefined value, or is configured to replace at least one of the one or more extremum coefficients by a pseudo coefficient, wherein the spectral value of the pseudo coefficient is different from the predefined value, a processing unit for processing the modified audio signal spectrum to acquire an encoded audio signal spectrum, and a side information generator for generating and transmitting side information, wherein the side information generator is configured to locate one or more pseudo coefficient candidates within the modified audio signal input spectrum generated by the spectrum modifier, wherein the side information generator is configured to select at least one of the pseudo coefficient candidates as selected candidates, and wherein the side information generator is configured to generate the side information so that the side information indicates the selected candidates as the pseudo coefficients, wherein the extrema determiner is configured to determine the one or more extremum coefficients, so that each of the extremum coefficients is one of the spectral coefficients the spectral value of which is greater than the spectral value of at least one of its predecessors and the spectral value of which is greater than the spectral value of at least one of its successors, or wherein each of the spectral coefficients has a comparison value associated with said spectral coefficient, wherein the extrema determiner is configured to determine the one or more extremum coefficients, so that each of the extremum coefficients is one of the spectral coefficients the comparison value of which is greater than the comparison value of at least one of its predecessors and the comparison value of which is greater than the comparison value of at least one of its successors.

According to another embodiment, a method for generating an audio output signal based on an encoded audio signal spectrum, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients, and wherein the method may have the steps of: processing the encoded audio signal spectrum to acquire a decoded audio signal spectrum the decoded audio signal spectrum having a plurality of spectral coefficients, determining one or more pseudo coefficients of the decoded audio signal spectrum, each of the pseudo coefficients having a spectral location and a spectral value, setting the one or more pseudo coefficients to a predefined value to acquire a modified audio signal spectrum, converting the modified audio signal spectrum to a time-domain to acquire a time-domain conversion signal, generating a time-domain oscillator signal by a controllable oscillator being controlled by the spectral location and the spectral value of at least one of the one or more pseudo coefficients, and mixing the time-domain conversion signal and the time-domain oscillator signal to acquire the audio output signal.

According to another embodiment, a method for encoding an audio signal input spectrum, the audio signal input spectrum having a plurality of spectral coefficients, wherein each of the spectral coefficients has a spectral location within the audio signal input spectrum, a spectral value and a comparison value, wherein the spectral coefficients are sequentially ordered according to their spectral location within the audio signal input spectrum so that the spectral coefficients form a sequence of spectral coefficients, wherein each of the spectral coefficients has at least one of one or more predecessors and one or more successors, wherein each one of the predecessors of said spectral coefficient is one of the spectral coefficients that precedes said spectral coefficient within the sequence, wherein each one of the successors of said spectral coefficient is one of the spectral coefficients that succeeds said spectral coefficient within the sequence, and wherein the method may have the steps of: determining one or more extremum coefficients, modifying the audio signal input spectrum to acquire a modified audio signal spectrum by setting the spectral value of at least one of the predecessors or at least one of the successors of at least one of the extremum coefficients to a predefined value, wherein modifying the audio signal input spectrum is conducted by not setting the spectral values of the one or more extremum coefficients to the predefined value, or by replacing at least one of the one or more extremum coefficients by a pseudo coefficient, wherein the spectral value of the pseudo coefficient is different from the predefined value, processing the modified audio signal spectrum to acquire an encoded audio signal spectrum, and generating and transmitting side information, wherein the side information is generated by locating one or more pseudo coefficient candidates within the modified audio signal input spectrum, wherein the side information is generated by selecting at least one of the pseudo coefficient candidates as selected candidates, and wherein the side information is generated so that the side information indicates the selected candidates as the pseudo coefficients, wherein the one or more extremum coefficients are determined, so that each of the extremum coefficients is one of the spectral coefficients the spectral value of which is greater than the spectral value of at least one of its predecessors and the spectral value of which is greater than the spectral value of at least one of its successors, or wherein each of the spectral coefficients has a comparison value associated with said spectral coefficient, wherein the one or more extremum coefficients are determined, so that each of the extremum coefficients is one of the spectral coefficients the comparison value of which is greater than the comparison value of at least one of its predecessors and the comparison value of which is greater than the comparison value of at least one of its successors.

Another embodiment may have a computer program for implementing the method of claim 29 when being executed on a computer or signal processor.

Another embodiment may have a computer program for implementing the method of claim 30 when being executed on a computer or signal processor.

An apparatus for generating an audio output signal based on an encoded audio signal spectrum is provided.

The apparatus comprises a processing unit for processing the encoded audio signal spectrum to obtain a decoded audio signal spectrum. The decoded audio signal spectrum comprises a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients.

Moreover, the apparatus comprises a pseudo coefficients determiner for determining one or more pseudo coefficients of the decoded audio signal spectrum, each of the pseudo coefficients having a spectral location and a spectral value.

Furthermore, the apparatus comprises a spectrum modification unit for setting the one or more pseudo coefficients to a predefined value to obtain a modified audio signal spectrum.

Moreover, the apparatus comprises a spectrum-time conversion unit for converting the modified audio signal spectrum to a time-domain to obtain a time-domain conversion signal.

Furthermore, the apparatus comprises a controllable oscillator for generating a time-domain oscillator signal, the controllable oscillator being controlled by the spectral location and the spectral value of at least one of the one or more pseudo coefficients.

Moreover, the apparatus comprises a mixer for mixing the time-domain conversion signal and the time-domain oscillator signal to obtain the audio output signal.

The proposed concepts enhance the perceptual quality of conventional block based transform codecs at low bit rates. It is proposed to substitute local tonal regions in audio signal spectra, spanning neighbouring local minima, encompassing a local maximum, by pseudo-lines (also referred to as pseudo coefficients) having, in some embodiments, a similar energy or level as said regions to be substituted.

According to embodiments, low delay and low bit rate audio coding is provided. Some embodiments are based on a new and inventive concept referred to as ToneFilling (TF). The term ToneFilling denotes a coding technique, in which otherwise badly coded natural tones are replaced by perceptually similar yet pure sine tones. Thereby, amplitude modulation artifacts at a certain rate, dependent on spectral position of the sinusoid with respect to the spectral location of the nearest MDCT bin, are avoided (known as "warbling").

According to embodiments, a degree of annoyance of all conceivable artifacts is weighted. This relates to perceptual aspects like e.g. pitch, harmonicity, modulation and to stationary of artifacts. All aspects are evaluated in a Sound Perception Annoyance Model (SPAM). Steered by such a model, ToneFilling provides significant advantages. A pitch and modulation error that is introduced by replacing a natural tone with a pure sine tone, is weighted versus an impact of additive noise and poor stationarity ("warbling") caused by a sparsely quantized natural tone.

ToneFilling provides significant differences to sinusoids-plus-noise codecs. For example, TF substitutes tones by sines, instead of a subtraction of sinusoids. Perceptually similar tones have the same local Centers Of Gravity (COG) as the original sound component to be substituted. According to embodiments, original tones are erased in the audio spectrum (left to right foot of COG function). Typically, the frequency resolution of the sinusoid used for substitution is as coarse as possible to minimize side information, while, at the same time, accounting for perceptual requirements to avoid an out-of-tune sensation.

In some embodiments, ToneFilling may be conducted above a lower cut-off frequency due to said perceptual requirements, but not below the lower cut-off frequency. When conducting ToneFilling, tones are represented via spectral pseudo-lines within a transform coder. However, in a ToneFilling equipped encoder, pseudo-lines are subjected to the regular processing controlled by the classic psychoacoustic model. Therefore, when conducting ToneFilling, there is no need for a-priori restrictions of the parametric part (at bit rate x, y tonal components are substituted). Such, a tight integration into a transform codec is achieved.

ToneFilling functionality may be employed at the encoder, by detecting local COGs (smoothed estimates; peak quality measures), by removing tonal components, by generating substituted pseudo-lines (e.g. pseudo coefficients) which carry a level information via the amplitude of the pseudo-lines, a frequency information via the spectral position of the pseudo-lines and a fine frequency information {half bin offset) via the sign of the pseudo-lines. Pseudo coefficients (pseudo-lines) are handled by a subsequent quantizer unit of the codec just like any regular spectral coefficient (spectral line).

ToneFilling may moreover be employed at the decoder by detecting isolated spectral lines, wherein true pseudo coefficients (pseudo-lines) may be marked by flag array (e.g. a bit field). The decoder may link pseudo-line information to build sinusoidal tracks. A birth/continuation/death scheme may be employed to synthesize continuous tracks.

For decoding, pseudo coefficients (pseudo-lines) may be marked as such by a flag array transmitted within the side information. A half-bin frequency resolution of the pseudo-lines can be signalled by the sign of the pseudo coefficients (pseudo-lines). At the decoder, the pseudo-lines may be erased from the spectrum before the inverse transform unit and synthesized separately by a bank of oscillators. Over time, pairs of oscillators may be linked and parameter interpolation is employed to ensure a smoothly evolving oscillator output.

The on- and offsets of the parameter-driven oscillators may be shaped such that they closely correspond to the temporal characteristics of the windowing operation of the transform codec thus ensuring seamless transition between transform codec generated parts and oscillator generated parts of the output signal.

The provided concepts integrate nicely and effortlessly into existing transform coding schemes like AAC, TCX or similar configurations. Steering of the parameter quantization precision may be implicitly performed by the codec's existing rate control.

According to an embodiment, each of the spectral coefficients may have at least one of an immediate predecessor and an immediate successor, wherein the immediate predecessor of said spectral coefficient may be one of the spectral coefficients that immediately precedes said spectral coefficient within the sequence, wherein the immediate successor of said spectral coefficient may be one of the spectral coefficients that immediately succeeds said spectral coefficient within the sequence. The pseudo coefficients determiner may be configured to determine the one or more pseudo coefficients of the decoded audio signal spectrum by determining at least one spectral coefficient of the sequence which has a spectral value which is different from the predefined value, which has an immediate predecessor the spectral value of which is equal to the predefined value, and which has an immediate successor the spectral value of which is equal to the predefined value.

In an embodiment, the predefined value may be zero.

According to an embodiment, the pseudo coefficients determiner may be configured to determine the one or more pseudo coefficients of the decoded audio signal spectrum by determining the at least one spectral coefficient of the sequence as a pseudo coefficient candidate, which has an immediate predecessor, the spectral value of which is equal to the predefined value, and which has an immediate successor, the spectral value of which is equal to the predefined value. The pseudo coefficients determiner may be configured to determine whether the pseudo coefficient candidate is a pseudo coefficient by determining whether side information indicates that said pseudo coefficient candidate is a pseudo coefficient.

In an embodiment, the controllable oscillator may be configured to generate the time-domain oscillator signal having a oscillator signal frequency so that the oscillator signal frequency of the oscillator signal depends on the spectral location of one of the one or more pseudo coefficients.

In some embodiments, the signal frequency of the oscillator signal is generated by conducting an interpolation between the spectral location of two or more temporally consecutive pseudo coefficients.

According to an embodiment, the pseudo coefficients are signed values, each comprising a sign component. The controllable oscillator may be configured to generate the time-domain oscillator signal so that the oscillator signal frequency of the oscillator signal furthermore depends on the sign component of one of the one or more pseudo coefficients so that the oscillator signal frequency has a first frequency value, when the sign component has a first sign value, and so that the oscillator signal frequency has a different second frequency value, when the sign component has a different second value.

In an embodiment, the controllable oscillator may be configured to generate the time-domain oscillator signal wherein the amplitude of the oscillator signal may depend on the spectral value of one of the one or more pseudo coefficients, so that the amplitude of the oscillator signal has a first amplitude value when the spectral value has a third value, and so that the amplitude of the oscillator signal has a different second amplitude value when the spectral value has a different fourth value, the second amplitude value being greater than the first amplitude value, when the fourth value is greater than the third value.

According to some embodiments, the amplitude value of the oscillator signal is generated by conducting an interpolation between the spectral values of two or more temporally consecutive pseudo coefficients. E.g. in some embodiments, the amplitude of the oscillator signal is generated by conducting an interpolation between the points in time for which a value is transmitted.

In an embodiment, the controllable oscillator may also be additionally controlled through extrapolated parameters derived from the pseudo coefficient of the preceding frame in order to e.g. conceal a data frame loss during transmission, or to smooth an unstable behaviour of the oscillator control.

According to some embodiments, the amplitude value of the oscillator signal is generated by conducting an interpolation between the spectral values of two or more pseudo coefficients. E.g. in some embodiments, the amplitude of the oscillator signal is generated by conducting an interpolation between the points in time for which a value is transmitted.

According to an embodiment, the modified audio signal spectrum may be an MDCT spectrum, comprising MDCT coefficients. The spectrum-time conversion unit may be configured to convert the MDCT spectrum from an MDCT domain to the time domain by converting at least some of the coefficients of the decoded audio signal spectrum to the time domain.

In an embodiment, the mixer may be configured to mix the time-domain conversion signal and the time-domain oscillator signal by adding the time-domain conversion signal to the time-domain oscillator signal in the time-domain.

Moreover, an apparatus for encoding an audio signal input spectrum is provided. The audio signal input spectrum comprises a plurality of spectral coefficients, wherein each of the spectral coefficients has a spectral location within the audio signal input spectrum and a spectral value. The spectral coefficients are sequentially ordered according to their spectral location within the audio signal input spectrum so that the spectral coefficients form a sequence of spectral coefficients. Each of the spectral coefficients has at least one of has at least one of one or more predecessors and has at least one of one or more successors, wherein each one of the predecessors of said spectral coefficient is one of the spectral coefficients that precedes said spectral coefficient within the sequence. Each one of the successors of said spectral coefficient is one of the spectral coefficients that succeeds said spectral coefficient within the sequence.

The apparatus comprises an extrema determiner for determining one extremum or more extrema, advantageously in a higher spectral resolution as provided by the underlying time-frequency transform.

For example the audio signal input spectrum may be an MDCT spectrum having a plurality of MDCT coefficients.

The extrema determiner may determine the extremum or the extrema on a comparison spectrum, wherein a comparison value of a coefficient of the comparison spectrum is assigned to each of the MDCT coefficients of the MDCT spectrum. However, the comparison spectrum may have a higher spectral resolution than the audio signal input spectrum. For example, the comparison spectrum may be a Discrete Fourier Transform (DFT) spectrum (evenly or oddly stacked DFT) having twice the spectral resolution than the MDCT audio signal input spectrum. By this, only every second spectral value of the DFT spectrum is then assigned to a spectral value of the MDCT spectrum. However, the other coefficients of the comparison spectrum may be taken into account when the extremum or the extrema of the comparison spectrum are determined. By this, a coefficient of the comparison spectrum may be determined as an extremum which is not assigned to a spectral coefficient of the audio signal input spectrum, but which has an immediate predecessor and an immediate successor, which are assigned to a spectral coefficient of the audio signal input spectrum and to the immediate successor of that spectral coefficient of the audio signal input spectrum, respectively. Thus, it can be considered that said extremum of the comparison spectrum (e.g. of the high-resolution DFT spectrum) is assigned to a spectral location within the (MDCT) audio signal input spectrum which is located between said spectral coefficient of the (MDCT) audio signal input spectrum and said immediate successor of said spectral coefficient of the (MDCT) audio signal input spectrum. Such a situation may be encoded by choosing an appropriate sign value of the pseudo coefficient as explained later on. By this, sub-bin resolution is achieved.

Moreover, the apparatus comprises a spectrum modifier for modifying the audio signal input spectrum to obtain a modified audio signal spectrum by setting the spectral value of at least one of the predecessors or the at least one of the successors of at least one of the extremum coefficients to a predefined value. Moreover, the spectrum modifier is configured to not set the spectral values of the one or more extremum coefficients to the predefined value, or is configured to replace at least one of the one or more extremum coefficients by a pseudo coefficient, wherein the spectral value of the pseudo coefficient is different from the predefined value.

Furthermore, the apparatus comprises a processing unit for processing the modified audio signal spectrum to obtain an encoded audio signal spectrum.

Moreover, the apparatus comprises a side information generator for generating and transmitting side information, wherein the side information generator is configured to locate one or more pseudo coefficient candidates within the modified audio signal input spectrum generated by the spectrum modifier, wherein the side information generator is configured to select at least one of the pseudo coefficient candidates as selected candidates, and wherein the side information generator is configured to generate the side information so that the side information indicates the selected candidates as the pseudo coefficients.

The extrema determiner is configured to determine the one or more extremum coefficients, advantageously in a higher spectral resolution as provided by the underlying time-frequency transform, so that each of the extremum coefficients is one of the spectral coefficients the spectral value of which is greater than the spectral value of at least one of its predecessors and the spectral value of which is greater than the spectral value of at least one of its successors. Or, each of the spectral coefficients has a comparison value associated with said spectral coefficient, and the extrema determiner is configured to determine the one or more extremum coefficients, so that each of the extremum coefficients is one of the spectral coefficients the comparison value of which is greater than the comparison value of at least one of its predecessors and the comparison value of which is greater than the comparison value of at least one of its successors.

According to embodiments, the side information generated by the side information generator can be of a static, predefined size or its size can be estimated iteratively in a signal-adaptive manner. In this case, the actual size of the side information is transmitted to the decoder as well. So, according to an embodiment, the side information generator 440 is configured to transmit the size of the side information.

In an embodiment, the spectrum modifier is configured to modify the audio signal input spectrum so that the spectral values of at least some of the spectral coefficients of the audio signal input spectrum are left unmodified in the modified audio signal spectrum.

According to an embodiment, each of the spectral coefficients has at least one of an immediate predecessor as one of its predecessors and an immediate successor as one of its successors, wherein the immediate predecessor of said spectral coefficient is one of the spectral coefficients that immediately precedes said spectral coefficient within the sequence, wherein the immediate successor of said spectral coefficient is one of the spectral coefficients that immediately succeeds said spectral coefficient within the sequence.

The spectrum modifier may be configured to modify the audio signal input spectrum to obtain the modified audio signal spectrum by setting the spectral value of the immediate predecessor or the immediate successor of at least one of the extremum coefficients to the predefined value, wherein the spectrum modifier may be configured to not set the spectral values of the one or more extremum coefficients to the predefined value, or may be configured to replace at least one of the one or more extremum coefficients by a pseudo coefficient, wherein the spectral value of the pseudo coefficient is different from the predefined value. It should be noted, that, when the extrema determiner determines the extremum coefficients based on a comparison spectrum (e.g. a power spectrum), the spectral coefficients, which may, for example, be a local maximum of the comparison spectrum (e.g. the power spectrum) do not have to be a local maximum of the audio signal input spectrum (e.g. the MDCT spectrum).

The extrema determiner may be configured to determine the one or more extremum coefficients, so that each of the extremum coefficients is one of the spectral coefficients the spectral value of which is greater than the spectral value of its immediate predecessor and the spectral value of which is greater than the spectral value of its immediate successor. Or each of the spectral coefficients has a comparison value associated with said spectral coefficient, and the extrema determiner may be configured to determine the one or more extremum coefficients, so that each of the extremum coefficients is one of the spectral coefficients the comparison value of which is greater than the comparison value of its immediate predecessor and the comparison value of which is greater than the comparison value of its immediate successor.

According to an embodiment, the extrema determiner may be configured to determine one or more minimum coefficients, so that each of the one or more minimum coefficients is one of the spectral coefficients the spectral value of which is smaller than the spectral value of one of its predecessors and the spectral value of which is smaller than the spectral value of one of its successors, or wherein each of the spectral coefficients has a comparison value associated with said spectral coefficient, wherein the extrema determiner is configured to determine the one or more minimum coefficients, so that each of the minimum coefficients is one of the spectral coefficients the comparison value of which is smaller than the comparison value of one of its predecessors and the comparison value of which is smaller than the comparison value of one of its successors. In such an embodiment, the spectrum modifier may be configured to determine a representation value based on the spectral values or comparison values of one or more of the extremum coefficients and one or more of the minimum coefficients, so that the representation value is different from the predefined value. Furthermore, the spectrum modifier may be configured to change the spectral value of one of the coefficients of the audio signal input sequence by setting said spectral value to the representation value.

According to an embodiment, the spectrum modifier may be configured to determine whether a value difference between one of the comparison value or the spectral value of one of the extremum coefficients is smaller than a threshold value. Moreover, the spectrum modifier may be configured to modify the audio signal input spectrum so that the spectral values of at least some of the spectral coefficients of the audio signal input spectrum are left unmodified in the modified audio signal spectrum depending on whether the value difference is smaller than the threshold value.

In an embodiment, the extrema determiner may be configured to determine one or more sub-sequences of the sequence of spectral values, so that each one of the sub-sequences comprises a plurality of subsequent spectral coefficients the audio signal input spectrum. The subsequent spectral coefficients may be sequentially ordered within the sub-sequence according to their spectral position. Each of the sub-sequences may have a first element being first in said sequentially-ordered sub-sequence and a last element being last in said sequentially-ordered sub-sequence. Moreover, each of the sub-sequences may comprise exactly two of the minimum coefficients and exactly one of the extremum coefficients, one of the minimum coefficients being the first element of the sub-sequence, the other one of the minimum coefficients being the last element of the sub-sequence. In such an embodiment, the spectrum modifier may be configured to determine the representation value based on the spectral values or the comparison values of the coefficients of one of the sub-sequences. The spectrum modifier may be configured to change the spectral value of one of the coefficients of said sub-sequence by setting said spectral value to the representation value.

According to an embodiment, the extrema determiner may be configured to determine a center-of-gravity coefficient by determining the product of the comparison value and the location value for each spectral coefficient of the sub-sequence to obtain a plurality of weighted coefficients, by summing up the weighted coefficients to obtain a first sum, summing up the comparison values of all spectral coefficients of the sub-sequence to obtain a second sum; by dividing the first sum by the second sum to obtain an intermediate result; and by applying round-to-nearest rounding on the intermediate result to obtain the center-of-gravity coefficient, and wherein the spectrum modifier is configured to set the spectral values of all spectral coefficients of the sub-sequence, which are not the center-of-gravity coefficient to the predefined value. Or, the extrema determiner may be configured to determine a center-of-gravity coefficient by determining the product of the spectral value and the location value for each spectral coefficient of the sub-sequence to obtain a plurality of weighted coefficients, by summing up the weighted coefficients to obtain a first sum, summing up the spectral values of all spectral coefficients of the sub-sequence to obtain a second sum; by dividing the first sum by the second sum to obtain an intermediate result; and by applying round-to-nearest rounding on the intermediate result to obtain the center-of-gravity coefficient, and wherein the spectrum modifier is configured to set the spectral values of all spectral coefficients of the sub-sequence, which are not the center-of-gravity coefficient to the predefined value.

In an embodiment, the predefined value is zero.

According to an embodiment, the comparison value of each spectral coefficient is a square value of a further coefficient of a further spectrum resulting from an energy preserving transformation of the audio signal.

In an embodiment, wherein the comparison value of each spectral coefficient is an amplitude value of a further coefficient of a further spectrum resulting from an energy preserving transformation of the audio signal.

According to an embodiment, the further spectrum is a Discrete Fourier Transform (DFT) spectrum and wherein the energy preserving transformation is a Discrete Fourier Transform (evenly or oddly stacked DFT).

According to another embodiment, the further spectrum is a Complex Modified Discrete Cosine Transform (CMDCT) spectrum and wherein the energy preserving transformation is a CMDCT.

According to an embodiment, the spectrum modifier may be configured to receive fine-tuning information. The coefficients of the audio signal input spectrum may be signed values, each comprising a sign component. The spectrum modifier may be configured to set the sign component one of the one or more extremum coefficients or of the pseudo coefficient to a first sign value, when the fine-tuning information is in a first fine-tuning state. And the spectrum modifier may be configured to set the sign component one of the one or more extremum coefficients or of the pseudo coefficient to a different second sign value, when the fine-tuning information is in a different second fine-tuning state.

In an embodiment, the audio signal input spectrum may be an MDCT spectrum comprising MDCT coefficients.

According to an embodiment, the processing unit may be configured to quantize the modified audio signal spectrum to obtain a quantized audio signal spectrum. The processing unit may furthermore be configured to process the quantized audio signal spectrum to obtain an encoded audio signal spectrum. Moreover, the processing unit may furthermore be configured to generate side information indicating only for those spectral coefficients of the quantized audio signal spectrum which have an immediate predecessor the spectral value of which is equal to the predefined value and an immediate successor, the spectral value of which is equal to the predefined value, whether a said coefficient is one of the extremum coefficients. The immediate predecessor of said spectral coefficient is another spectral coefficient which immediately precedes said spectral coefficient within the quantized audio signal spectrum, and wherein the immediate successor of said spectral coefficient is another spectral coefficient which immediately succeeds said spectral coefficient within the quantized audio signal spectrum.

Moreover, a method for generating an audio output signal based on an encoded audio signal spectrum is provided. Each of the spectral coefficients has a spectral location within the encoded audio signal spectrum and a spectral value. The spectral coefficients are sequentially ordered according to their spectral location within the encoded audio signal spectrum so that the spectral coefficients form a sequence of spectral coefficients. The method for generating an audio output signal comprises:

Processing the encoded audio signal spectrum to obtain a decoded audio signal spectrum the decoded audio signal spectrum comprising a plurality of spectral coefficients.

Determining one or more pseudo coefficients of the decoded audio signal spectrum, each of the pseudo coefficients having a spectral location and a spectral value.

Setting the one or more pseudo coefficients to a predefined value to obtain a modified audio signal spectrum.

Converting the modified audio signal spectrum to a time-domain to obtain a time-domain conversion signal.

Generating a time-domain oscillator signal by a controllable oscillator being controlled by the spectral location and the spectral value of at least one of the one or more pseudo coefficients. And:

Mixing the time-domain conversion signal and the time-domain oscillator signal to obtain the audio output signal.

Furthermore, a method for encoding an audio signal input spectrum is provided. The audio signal input spectrum comprises a plurality of spectral coefficients. Each of the spectral coefficients has a spectral location within the audio signal input spectrum and a spectral value. The spectral coefficients are sequentially ordered according to their spectral location within the audio signal input spectrum so that the spectral coefficients form a sequence of spectral coefficients. Each of the spectral coefficients has at least one of has at least one of one or more predecessors and has at least one of one or more successors. Each predecessor of said spectral coefficient is one of the spectral coefficients that precedes said spectral coefficient within the sequence. Each successor of said spectral coefficient is one of the spectral coefficients that succeeds said spectral coefficient within the sequence. The method for encoding an audio signal input spectrum comprises:

Determining one or more extremum coefficients.

Modifying the audio signal input spectrum to obtain a modified audio signal spectrum by setting the spectral value of at least one of the predecessors or at least one of the successors of at least one of the extremum coefficients to a predefined value, wherein modifying the audio signal input spectrum is conducted by not setting the spectral values of the one or more extremum coefficients to the predefined value, or by replacing at least one of the one or more extremum coefficients by a pseudo coefficient, wherein the spectral value of the pseudo coefficient is different from the predefined value.

Processing the modified audio signal spectrum to obtain an encoded audio signal spectrum. And:

Generating and transmitting side information, wherein the side information is generated by locating one or more pseudo coefficient candidates within the modified audio signal input spectrum, wherein the side information is generated by selecting at least one of the pseudo coefficient candidates as selected candidates, and wherein the side information is generated so that the side information indicates the selected candidates as the pseudo coefficients.

The one or more extremum coefficients are determined, so that each of the extremum coefficients is one of the spectral coefficients the spectral value of which is greater than the spectral value of one of its predecessors and the spectral value of which is greater than the spectral value of one of its successors. Or, each of the spectral coefficients has a comparison value associated with said spectral coefficient, wherein the one or more extremum coefficients are determined, so that each of the extremum coefficients is one of the spectral coefficients the comparison value of which is greater than the comparison value of at least one of its predecessors and the comparison value of which is greater than the comparison value of at least one of its successors.

Moreover, a computer program for implementing the above-described methods when being executed on a computer or signal processor is provided.

An audio encoder, audio decoder, related methods and programs or encoded audio signal are provided. Moreover, concepts for sinusoidal substitution for waveform coders are provided.

At low bit rates, the present invention provides concepts how to tightly integrate waveform coding and parametric coding to obtain an improved perceptual quality and an improved scaling of perceptual quality versus bit rate over the single techniques.

In some embodiments, peaky areas (spanning neighbouring local minima, encompassing a local maximum) of spectra may be fully substituted by a single sinusoid each; as opposed to sinusoidal coders which iteratively subtract synthesized sinusoids from the residual. Suitable peaky areas are extracted on a smoothed and slightly whitened spectral representation and are selected with respect to certain features (peak height, peak shape).

According to some embodiments, these substitution sinusoids may be represented as pseudo-lines (pseudo coefficients) within the spectrum to be coded and reflect the full amplitude or energy of the sinusoid (as opposed, e.g. regular MDCT lines correspond to the real projection of the true value).

In some embodiments, pseudo-lines (pseudo coefficients) may be handled by the codecs existing quantizer just like any regular spectral line; as opposed to separate signalling of sinusoidal parameters.

According to some embodiments, pseudo-lines (pseudo coefficients) may be marked as such by side info flag array.

In some embodiments, the choice of sign of the pseudo-lines may denote semi subband frequency resolution.

According to some embodiments, a lower cut-off frequency for sinusoidal substitution may be advisable due to the limited frequency resolution (e.g. semi-subband).

In some embodiments, in the decoder, pseudo-lines may be deleted from the regular spectrum; pseudo-line synthesis is accomplished by a bank of interpolating oscillators.

In some embodiments, an optionally measured start phase of a sinusoidal track obtained from extrapolation of preceding spectra may be employed.

According to some embodiments, an optional Time Domain Alias Cancellation (TDAC) technique may be employed by modelling of the alias at on-/off-set of a sinusoidal track.

According to some embodiments, an optional TDAC alias cancellation by modelling of alias at on-/off-set may be employed.

BRIEF DESCRIPTION OF THE DRAWINGS

Embodiments of the present invention will be detailed subsequently referring to the appended drawings, in which:

FIG. 4 illustrates an apparatus for encoding an audio signal input spectrum according to an embodiment. The apparatus for encoding comprises an extrema determiner 410, a spectrum modifier 420, a processing unit 430 and a side information generator 440.

DETAILED DESCRIPTION OF THE INVENTION

Figure 4:
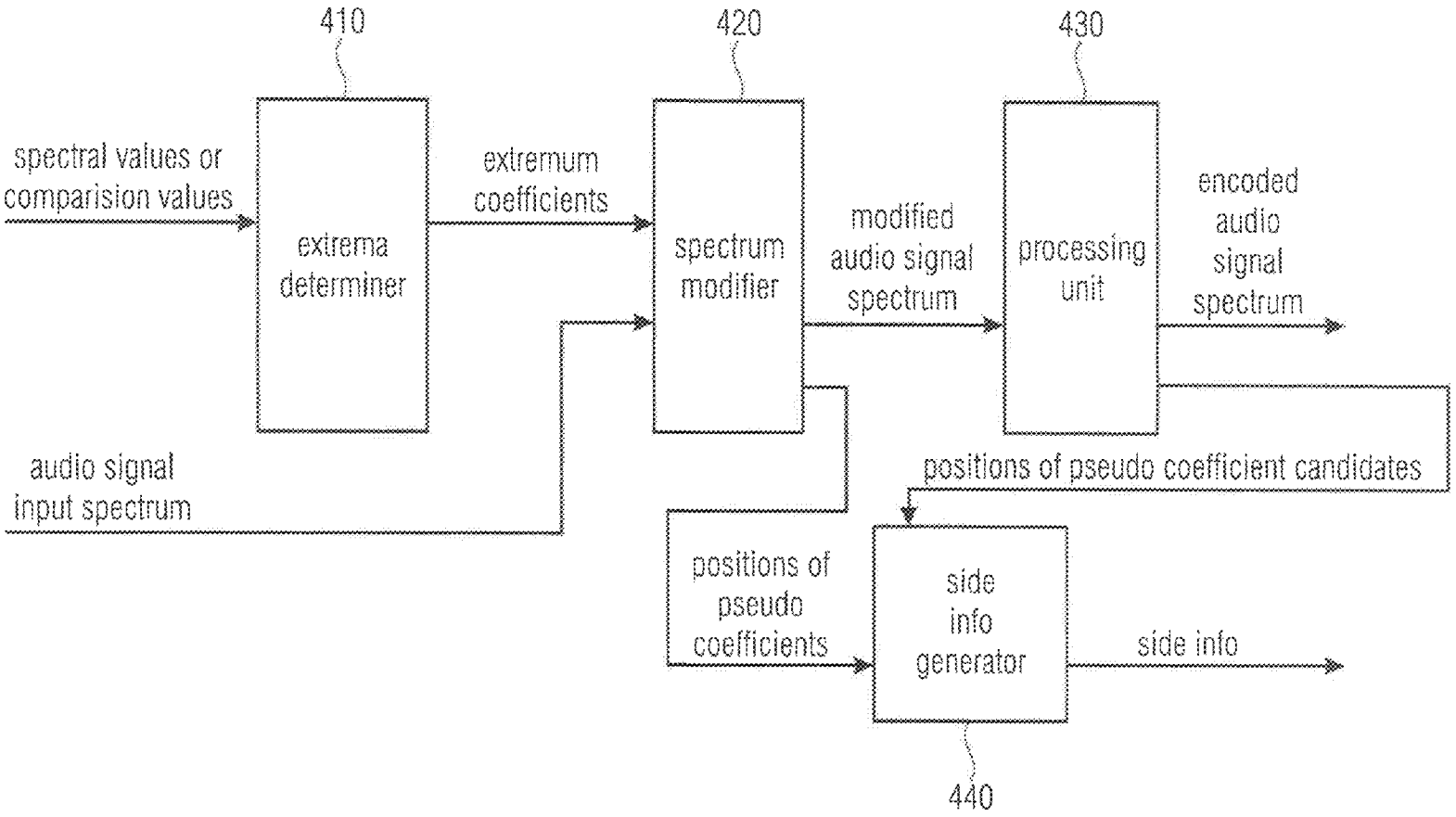
FIG. 4 illustrates an apparatus for encoding an audio signal input spectrum according to an embodiment.

Before considering the apparatus of FIG. 4 in more detail, the audio signal input spectrum that is encoded by the apparatus of FIG. 4 is considered in more detail.

In principle any kind of audio signal spectrum can be encoded by the apparatus of FIG. 4. The audio signal input spectrum may, for example, be an MDCT (Modified Discrete Cosine Transform) spectrum, a DFT (Discrete Fourier Transform) magnitude spectrum or an MDST (Modified Discrete Sine Transform) spectrum.

Figure 5:
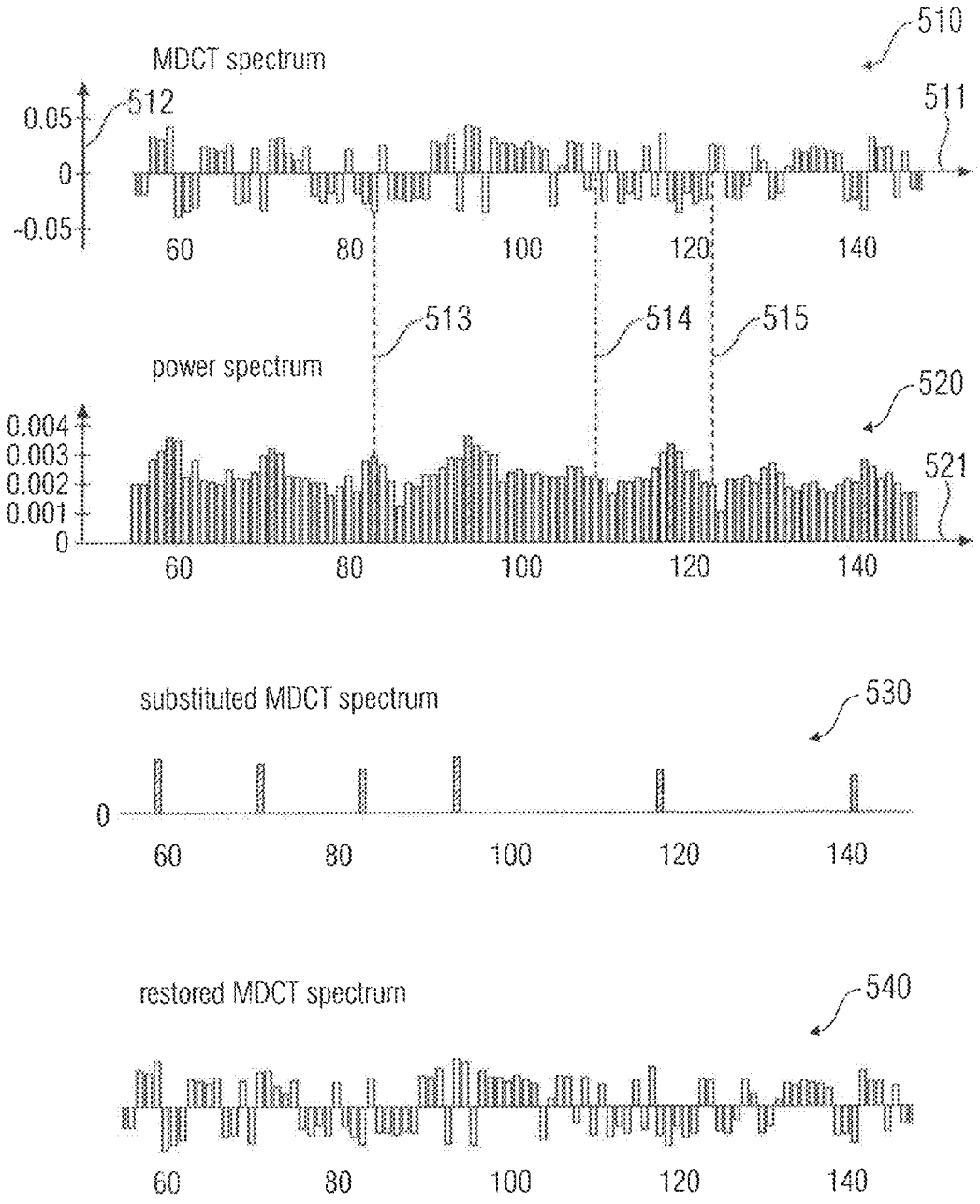
FIG. 5 depicts an audio signal input spectrum, a corresponding power spectrum and a modified (substituted) audio signal spectrum.

FIG. 5 illustrates an example of an audio signal input spectrum 510. In FIG. 5, the audio signal input spectrum 510 is an MDCT spectrum.

The audio signal input spectrum comprises a plurality of spectral coefficients. Each of the spectral coefficients has a spectral location within the audio signal input spectrum and a spectral value.

Considering the example of FIG. 5, where the audio signal input spectrum results from an MDCT transform of the audio signal, e.g., a filter bank that has transformed the audio signal to obtain the audio signal input spectrum, may, for example, use 1024 channels. Then, each of the spectral coefficients is associated with one of the 1024 channels and the channel number (for example, a number between 0 and 1023) may be considered as the spectral location of said spectral coefficients. In FIG. 5, the abscissa 511 refers to the spectral location of the spectral coefficients. For better illustration, only the coefficients with spectral locations between 52 and 148 are illustrated by FIG. 5.

In FIG. 5, the ordinate 512 helps to determine the spectral value of the spectral coefficients. In the example of FIG. 5 which depicts an MDCT spectrum, there, the spectral values of the spectral coefficients of the audio signal input spectrum, the abscissa 512 refers to the spectral values of the spectral coefficients. It should be noted that spectral coefficients of an MDCT audio signal input spectrum can have positive as well as negative real numbers as spectral values.

Other audio signal input spectra, however, may only have spectral coefficients with spectral values that are positive or zero. For example, the audio signal input spectrum may be a DFT magnitude spectrum, with spectral coefficients having spectral values that represent the magnitudes of the coefficients resulting from the Discrete Fourier Transform. Those spectral values can only be positive or zero.

In further embodiments, the audio signal input spectrum comprises spectral coefficients with spectral values that are complex numbers. For example, a DFT spectrum indicating magnitude and phase information may comprise spectral coefficients having spectral values which are complex numbers.

As exemplarily shown in FIG. 5, the spectral coefficients are sequentially ordered according to their spectral location within the audio signal input spectrum so that the spectral coefficients form a sequence of spectral coefficients. Each of the spectral coefficients has at least one of one or more predecessors and one or more successors, wherein each predecessor of said spectral coefficient is one of the spectral coefficients that precedes said spectral coefficient within the sequence. Each successor of said spectral coefficient is one of the spectral coefficients that succeeds said spectral coefficient within the sequence. For example, in FIG. 5, a spectral coefficient having the spectral location 81, 82 or 83 (and so on) is a successor for the spectral coefficient with the spectral location 80. A spectral coefficient having the spectral location 79, 78 or 77 (and so on) is a predecessor for the spectral coefficient with the spectral location 80. For the example of an MDCT spectrum, the spectral location of a spectral coefficient may be the channel of the MDCT transform, the spectral coefficient relates to (for example, a channel number between, e.g. 0 and 1023). Again it should be noted that, for illustrative purposes, the MDCT spectrum 510 of FIG. 5 only illustrates spectral coefficients with spectral locations between 52 and 148.

Returning to FIG. 4, the extrema determiner 410 is now described in more detail. The extrema determiner 410 is configured to determine one or more extremum coefficients.

In general, the extrema determiner 410 examines the audio signal input spectra or a spectrum that is related to the audio signal input spectrum for extremum coefficients. The purpose of determining extremum coefficients is, that later on, one or more local tonal regions shall be substituted in the audio signal spectrum by pseudo coefficients, for example, by a single pseudo coefficient for each tonal region.

In general, peaky areas in a power spectrum of the audio signal, the audio signal input spectrum relates to, indicate tonal regions. It may therefore be advantageous to identify peaky areas in a power spectrum of the audio signal to which the audio signal input spectrum relates. The extrema determiner 410 may, for example, examine a power spectrum, comprising coefficients, which may be referred to as comparison coefficients (as their spectral values are pairwise compared by the extrema determiner), so that each of the spectral coefficients of the audio signal input spectrum has a comparison value associated to it.

In FIG. 5, a power spectrum 520 is illustrated. The power spectrum 520 and the MDCT audio signal input spectrum 510 relate to the same audio signal. The power spectrum 520 comprises coefficients referred to as comparison coefficients. Each spectral coefficient comprises a spectral location which relates to abscissa 521 and a comparison value. Each spectral coefficient of the audio signal input spectrum has a comparison coefficient associated with it and thus, moreover has the comparison value of its comparison coefficient associated with it. For example, the comparison value associated with a spectral value of the audio signal input spectrum may be the comparison value of the comparison coefficient with the same spectral position as the considered spectral coefficient of the audio signal input spectrum. The association between three of the spectral coefficients of the audio signal input spectrum 510 and three of the comparison coefficients (and thus the association with the comparison values of these comparison coefficients) of the power spectrum 520 is indicated by the dashed lines 513, 514, 515 indicating an association of the respective comparison coefficients (or their comparison values) and the respective spectral coefficients of the audio signal input spectrum 510.

The extrema determiner 410 may be configured to determine one or more extremum coefficients, so that each of the extremum coefficients is one of the spectral coefficients the comparison value of which is greater than the comparison value of one of its predecessors and the comparison value of which is greater than the comparison value of one of its successors.

For example, the extrema determiner 410 may determine the local maxima values of the power spectrum. In other words, the extrema determiner 410 may be configured to determine the one or more extremum coefficients, so that each of the extremum coefficients is one of the spectral coefficients the comparison value of which is greater than the comparison value of its immediate predecessor and the comparison value of which is greater than the comparison value of its immediate successor. Here, the immediate predecessor of a spectral coefficient is the one of the spectral coefficients that immediately precedes said spectral coefficient in the power spectrum. The immediate successor of said spectral coefficient is one of the spectral coefficients that immediately succeeds said spectral coefficient in the power spectrum.

However, other embodiments do not require that the extrema determiner 410 determines all local maxima. For example, in some embodiments, the extrema determiner may only examine certain portions of the power spectrum, for example, relating to a certain frequency range, only.

In other embodiments, the extrema determiner 410 is configured to only those coefficients as extremum coefficients, where a difference between the comparison value of the considered local maximum and the comparison value of the subsequent local minimum and/or preceding local minimum is greater than a threshold value.

The extrema determiner 410 may determine the extremum or the extrema on a comparison spectrum, wherein a comparison value of a coefficient of the comparison spectrum is assigned to each of the MDCT coefficients of the MDCT spectrum. However, the comparison spectrum may have a higher spectral resolution than the audio signal input spectrum. For example, the comparison spectrum may be a DFT spectrum having twice the spectral resolution than the MDCT audio signal input spectrum. By this, only every second spectral value of the DFT spectrum is then assigned to a spectral value of the MDCT spectrum. However, the other coefficients of the comparison spectrum may be taken into account when the extremum or the extrema of the comparison spectrum are determined. By this, a coefficient of the comparison spectrum may be determined as an extremum which is not assigned to a spectral coefficient of the audio signal input spectrum, but which has an immediate predecessor and an immediate successor, which are assigned to a spectral coefficient of the audio signal input spectrum and to the immediate successor of that spectral coefficient of the audio signal input spectrum, respectively. Thus, it can be considered that said extremum of the comparison spectrum (e.g. of the high-resolution DFT spectrum) is assigned to a spectral location within the (MDCT) audio signal input spectrum which is located between said spectral coefficient of the (MDCT) audio signal input spectrum and said immediate successor of said spectral coefficient of the (MDCT) audio signal input spectrum. Such a situation may be encoded by choosing an appropriate sign value of the pseudo coefficient as explained later on. By this, sub-bin resolution is achieved.

It should be noted that in some embodiments, an extremum coefficient does not have to fulfil the requirement that its comparison value is greater than the comparison value of its immediate predecessor and the comparison value of its immediate successor. Instead, in those embodiments, it might be sufficient that the comparison value of the extremum coefficient is greater than one of its predecessors and one of its successors. Consider for example the situation, where:

TABLE 1

| Spectral Location | 212 | 213 | 214 | 215 | 216 |
|---|---|---|---|---|---|
| Comparison Value | 0.02 | 0.84 | 0.83 | 0.85 | 0.01 |

In the situation described by Table 1, the extrema determiner 410 may reasonably consider the spectral coefficient at spectral location 214 as an extremum coefficient. The comparison value of spectral coefficient 214 is not greater than that of its immediate predecessor 213 (0.83<0.84) and not greater than that of its immediate successor 215 (0.83<0.85), but it is (significantly) greater than the comparison value of another one of its predecessors, predecessor 212 (0.83>0.02), and it is (significantly) greater than the comparison value of another one of its successors, successor 216 (0.83>0.01). It appears moreover reasonable to consider spectral coefficient 214 as the extremum of this "peaky area", as spectral coefficient is located in the middle of the three coefficients 213, 214, 215 which have relatively big comparison values compared to the comparison values of coefficients 212 and 216.

For example, the extrema determiner 410 may be configured to determine form some or all of the comparison coefficients, whether the comparison value of said comparison coefficient is greater than at least one of the comparison values of the three predecessors being closest to the spectral location of said comparison coefficient. And/or, the extrema determiner 410 may be configured to determine form some or all of the comparison coefficients, whether the comparison value of said comparison coefficient is greater than at least one of the comparison values of the three successors being closest to the spectral location of said comparison coefficient. The extrema determiner 410 may then decide whether to select said comparison coefficient depending on the result of said determinations.

In some embodiments, the comparison value of each spectral coefficient is a square value of a further coefficient of a further spectrum (a comparison spectrum) resulting from an energy preserving transformation of the audio signal.

In further embodiments, the comparison value of each spectral coefficient is an amplitude value of a further coefficient of a further spectrum resulting from an energy preserving transformation of the audio signal.

According to an embodiment, the further spectrum is a Discrete Fourier Transform spectrum and wherein the energy preserving transformation is a Discrete Fourier Transform.

According to a further embodiment, the further spectrum is a Complex Modified Discrete Cosine Transform (CMDCT) spectrum, and wherein the energy preserving transformation is a CMDCT.

In another embodiment, the extrema determiner 410 may not examine a comparison spectrum, but instead, may examine the audio signal input spectrum itself. This may, for example, be reasonable, when the audio signal input spectrum itself results from an energy preserving transformation, for example, when the audio signal input spectrum is a Discrete Fourier Transform magnitude spectrum.

For example, the extrema determiner 410 may be configured to determine the one or more extremum coefficients, so that each of the extremum coefficients is one of the spectral coefficients the spectral value of which is greater than the spectral value of one of its predecessors and the spectral value of which is greater than the spectral value of one of its successors.

In an embodiment, the extrema determiner 410 may be configured to determine the one or more extremum coefficients, so that each of the extremum coefficients is one of the spectral coefficients the spectral value of which is greater than the spectral value of its immediate predecessor and the spectral value of which is greater than the spectral value of its immediate successor.

Moreover, the apparatus comprises a spectrum modifier 420 for modifying the audio signal input spectrum to obtain a modified audio signal spectrum by setting the spectral value of the predecessor or the successor of at least one of the extremum coefficients to a predefined value. The spectrum modifier 420 is configured to not set the spectral values of the one or more extremum coefficients to the predefined value, or is configured to replace at least one of the one or more extremum coefficients by a pseudo coefficient, wherein the spectral value of the pseudo coefficient is different from the predefined value. Advantageously, the predefined value may be zero. For example, in the modified (substituted) audio signal spectrum 530 of FIG. 5, the spectral values of a lot of spectral coefficients have been set to zero by the spectrum modifier 420.

In other words, to obtain the modified audio signal spectrum, the spectrum modifier 420 will set at least the spectral value of a predecessor or a successor of one of the extremum coefficients to a predefined value. The predefined value may e.g. be zero. The comparison value of such a predecessor or successor is smaller than the comparison value of said extremum value.

Moreover, regarding the extremum coefficients themselves, the spectrum modifier 420 will proceed as follows:

The spectrum modifier 420 will not set the extremum coefficients to the predefined value, or:

The spectrum modifier 420 will replace at least one of the extremum coefficients by a pseudo coefficient, wherein the spectral value of the pseudo coefficient is different from the predefined value. This means that the spectral value of at least one of the extremum coefficients is set to the predefined value, and the spectral value of another one of the spectral coefficients is set to a value which is different from the predefined value. Such a value may, for example, be derived from the spectral value of said extremum coefficient, of one of the predecessors of said extremum coefficient or of one of the successors of said extremum coefficient. Or, such a value may, for example, be derived from the comparison value of said extremum coefficient, of one of the predecessors of said extremum coefficient or of one of the successors of said extremum coefficient The spectrum modifier 420 may, for example, be configured to replace one of the extremum coefficients by a pseudo coefficient having a spectral value derived from the spectral value or the comparison value of said extremum coefficient, from the spectral value or the comparison value of one of the predecessors of said extremum coefficient or from the spectral value or the comparison value of one of the successors of said extremum coefficient.

Furthermore, the apparatus comprises a processing unit 430 for processing the modified audio signal spectrum to obtain an encoded audio signal spectrum.

For example, the processing unit 430 may be any kind of audio encoder, for example, an MP3 (MPEG-1 Audio Layer III or MPEG-2 Audio Layer III; MPEG=Moving Picture Experts Group) audio encoder, an audio encoder for WMA (Windows Media Audio), an audio encoder for WAVE-files or an MPEG-2/4 AAC (Advanced Audio Coding) audio encoder or an MPEG-D USAC (Unified Speed and Audio Coding) coder.

The processing unit 430 may, for example, be an audio encoder as described in [8] (ISO/IEC 14496-3:2005—Information technology—Coding of audio-visual objects—Part 3: Audio, Subpart 4) or as described in [9] (ISO/IEC 14496-3: 2005—Information technology—Coding of audio-visual objects—Part 3: Audio, Subpart 4). For example, the processing unit 430 may comprise a quantizer, and/or a temporal noise shaping tool, as, for example, described in [8] and/or the processing unit 430 may comprise a perceptual noise substitution tool, as, for example, described in [8].

Moreover, the apparatus comprises a side information generator 440 for generating and transmitting side information. The side information generator 440 is configured to locate one or more pseudo coefficient candidates within the modified audio signal input spectrum generated by the spectrum modifier 420. Furthermore, the side information generator 440 is configured to select at least one of the pseudo coefficient candidates as selected candidates. Moreover, the side information generator 440 is configured to generate the side information so that the side information indicates the selected candidates as the pseudo coefficients.

In the embodiment illustrated by FIG. 4, the side information generator 440 is configured to receive the positions of the pseudo coefficients (e.g. the position of each of the pseudo coefficients) by the spectrum modifier 420. Moreover, in the embodiment of FIG. 4, the side information generator 440 is configured to receive the positions of the pseudo coefficient candidates (e.g. the position of each of the pseudo coefficient candidates).

For example, in some embodiments, the processing unit 430 may be configured to determine the pseudo coefficient candidates based on a quantized audio signal spectrum. In an embodiment, the processing unit 430 may have generated the quantized audio signal spectrum by quantizing the modified audio signal spectrum. For example, the processing unit 430 may determine the at least one spectral coefficient of the quantized audio signal spectrum as a pseudo coefficient candidate, which has an immediate predecessor, the spectral value of which is equal to the predefined value (e.g. equal to 0), and which has an immediate successor, the spectral value of which is equal to the predefined value. Alternatively, in other embodiments, the processing unit 430 may pass the quantized audio signal spectrum to the side information generator 440 and the side information generator 440 may itself determine the pseudo coefficient candidates based on the quantized audio signal spectrum. According to other embodiments, the pseudo coefficient candidates are determined in an alternative way based on the modified audio signal spectrum.

The side information generated by the side information generator can be of a static, predefined size or its size can be estimated iteratively in a signal-adaptive manner. In this case, the actual size of the side information is transmitted to the decoder as well. So, according to an embodiment, the side information generator 440 is configured to transmit the size of the side information.

According to an embodiment, the extrema determiner 410 is configured to examine the comparison coefficients, for example, the coefficients of the power spectrum 520 in FIG. 5, and is configured to determine the one or more minimum coefficients, so that each of the minimum coefficients is one of the spectral coefficients the comparison value of which is smaller than the comparison value of one of its predecessors and the comparison value of which is smaller than the comparison value of one of its successors. In such an embodiment, the spectrum modifier 420 may be configured to determine a representation value based on the comparison values of one or more of the extremum coefficients and of one or more of the minimum coefficients, so that the representation value is different from the predefined value. Furthermore, the spectrum modifier 420 may be configured to change the spectral value of one of the coefficients of the audio signal input spectrum by setting said spectral value to the representation value.

In a specific embodiment, the extrema determiner is configured to examine the comparison coefficients, for example, the coefficients of the power spectrum 520 in FIG. 5, and is configured to determine the one or more minimum coefficients, so that each of the minimum coefficients is one of the spectral coefficients the comparison value of which is smaller than the comparison value of its immediate predecessor and the comparison value of which is smaller than the comparison value of its immediate successor.

Alternatively, the extrema determiner 410 is configured to examine the audio signal input spectrum 510 itself and is configured to determine one or more minimum coefficients, so that each of the one or more minimum coefficients is one of the spectral coefficients the spectral value of which is smaller than the spectral value of one of its predecessors and the spectral value of which is smaller than the spectral value of one of its successors. In such an embodiment, the spectrum modifier 420 may be configured to determine a representation value based on the spectral values of one or more of the extremum coefficients and of one or more of the minimum coefficients, so that the representation value is different from the predefined value. Moreover, the spectrum modifier 420 may be configured to change the spectral value of one of the coefficients of the audio signal input spectrum by setting said spectral value to the representation value.

In a specific embodiment, the extrema determiner 410 is configured to examine the audio signal input spectrum 510 itself and is configured to determine one or more minimum coefficients, so that each of the one or more minimum coefficients is one of the spectral coefficients the spectral value of which is smaller than the spectral value of its immediate predecessor and the spectral value of which is smaller than the spectral value of its immediate successor In both embodiments, the spectrum modifier 420 takes the extremum coefficient and one or more of the minimum coefficients into account, in particular their associated comparison values or their spectral values, to determine the representation value. Then, the spectral value of one of the spectral coefficients of the audio signal input spectrum is set to the representation value. For, the spectral coefficient, the spectral value of which is set to the representation value may, for example, be the extremum coefficient itself, or the spectral coefficient, the spectral value of which is set to the representation value may be the pseudo coefficient which replaces the extremum coefficient.

In an embodiment, the extrema determiner 410 may be configured to determine one or more sub-sequences of the sequence of spectral values, so that each one of the sub-sequences comprises a plurality of subsequent spectral coefficients of the audio signal input spectrum. The subsequent spectral coefficients are sequentially ordered within the sub-sequence according to their spectral position. Each of the sub-sequences has a first element being first in said sequentially-ordered sub-sequence and a last element being last in said sequentially-ordered sub-sequence.

In a specific embodiment, each of the sub-sequences may, for example, comprise exactly two of the minimum coefficients and exactly one of the extremum coefficients, one of the minimum coefficients being the first element of the sub-sequence, the other one of the minimum coefficients being the last element of the sub-sequence.

In an embodiment, the spectrum modifier 420 may be configured to determine the representation value based on the spectral values or the comparison values of the coefficients of one of the sub-sequences. For example, if the extrema determiner 410 has examined the comparison coefficients of the comparison spectrum, e.g. of the power spectrum 520, the spectrum modifier 420 may be configured to determine the representation value based on the comparison values of the coefficients of one of the sub-sequences. If, however, the extrema determiner 410 has examined the spectral coefficients of the audio signal input spectrum 510, the spectrum modifier 420 may be configured to determine the representation value based on the spectral values of the coefficients of one of the sub-sequences.

The spectrum modifier 420 is configured to change the spectral value of one of the coefficients of said sub-sequence by setting said spectral value to the representation value.

Table 2 provides an example with five spectral coefficients at the spectral locations 252 to 258.

TABLE 2

| | Spectral Location | | | | | | |
|---|---|---|---|---|---|---|---|
| | 252 | 253 | 254 | 255 | 256 | 257 | 258 |
| Comparison Value | 0.12 | 0.05 | 0.48 | 0.73 | 0.45 | 0.03 | 0.18 |

The extrema determiner 410 may determine that the spectral coefficient 255 (the spectral coefficient with the spectral location 255) is an extremum coefficient, as its comparison value (0.73) is greater than the comparison value (0.48) of its (here: immediate) predecessor 254, and as its comparison value (0.73) is greater than the comparison value (0.45) of its (here: immediate) successor 256.

Moreover, the extrema determiner 410 may determine that the spectral coefficient 253 (the is a minimum coefficient, as its comparison value (0.05) is smaller than the comparison value (0.12) of its (here: immediate) predecessor 252, and as its comparison value (0.05) is smaller than the comparison value (0.48) of its (here: immediate) successor 254.

Furthermore, the extrema determiner 410 may determine that the spectral coefficient 257 is a minimum coefficient as its comparison value (0.03) is smaller than the comparison value (0.45) of its (here: immediate) predecessor 256 and as its comparison value (0.03) is smaller than the comparison value (0.18) of its (here: immediate) successor 258.

The extrema determiner 410 may thus determine a sub-sequence comprising the spectral coefficients 253 to 257, by determining that spectral coefficient 255 is an extremum coefficient, by determining spectral coefficient 253 as the minimum coefficient being the closest preceding minimum coefficient to the extremum coefficient 255, and by determining spectral coefficient 257 as the minimum coefficient being the closest succeeding minimum coefficient to the extremum coefficient 255.

The spectrum modifier 420 may now determine a representation value for the sub-sequence 253-257 based on the comparison values of all the spectral coefficients 253-257.

For example, the spectrum modifier 420 may be configured to sum up the comparison values of all the spectral coefficients of the sub-sequence. (For example, for Table 2, the representation value for sub-sequence 253-257 then sums up to: 0.05+0.48+0.73+0.45+0.03=1.74).

Or, e.g., the spectrum modifier 420 may be configured to sum up the squares of the comparison values of all the spectral coefficients of the sub-sequence. (For example, for Table 2, the representation value for sub-sequence 253-257 then sums up to: $(0.05)^2+(0.48)^2+(0.73)^2+(0.45)^2+(0.03)^2=0.9692$).

Or, for example, the spectrum modifier 420 may be configured to square root the sum of the squares of the comparison values of all the spectral coefficients of the sub-sequence 253-257. (For example, for Table 2, the representation value is then 0.98448).

According to some embodiments, the spectrum modifier 420 will set the spectral value of the extremum coefficient (in Table to, the spectral value of spectral coefficient 253) to the predefined value.

Other embodiments, however, use a center-of-gravity approach. Table 3 illustrates a sub-sequence comprising the spectral coefficients 282-288:

TABLE 3

| Spectral Location | 281 | 282 | 283 | 284 | 285 | 286 | 287 | 288 | 289 |
|---|---|---|---|---|---|---|---|---|---|
| Comparison Value | 0.12 | 0.04 | 0.10 | 0.20 | 0.93 | 0.92 | 0.90 | 0.05 | 0.15 |

Although the extremum coefficient is located at spectral location 285, according to the center of gravity approach, the center-of-gravity is located at a different spectral location.

To determine the spectral location of the center-of-gravity, the extrema determiner 410 sums up weighted spectral locations of all spectral coefficients of the sub-sequence and divides the result by the sum of the comparison values of the spectral coefficients of the sub-sequence. Commercial rounding may then be employed on the result of the division to determine the center-of-gravity. The weighted spectral location of a spectral coefficient is the product of its spectral location and its comparison values.

In short: The extrema determiner may obtain the center-of-gravity by:

1) Determining the product of the comparison value and spectral location for each spectral coefficient of the sub-sequence.
2) Summing up the products determined in 1) to obtain a first sum
3) Summing up the comparison values of all spectral coefficients of the sub-sequence to obtain a second sum
4) Dividing the first sum by the second sum to generate an intermediate result; and
5) Apply round-to-nearest rounding on the intermediate result to obtain the center-of-gravity (round-to-nearest rounding: 8.49 is rounded to 8; 8.5 is rounded to 9)

Thus, for the example of Table 3, the center-of-gravity is obtained by:

$$(0.04\cdot 282+0.10\cdot 283+0.20\cdot 284+0.93\cdot 285+0.92\cdot 286+0.90\cdot 287+0.05\cdot 288)/(0.04+0.10+0.20+0.93+0.92+0.90+0.05)=897.25/3.14=285.75=286.$$

Thus, in the example of Table 3, the extrema determiner 410 would be configured to determine the spectral location 286 as the center-of-gravity.

In some embodiments, the extrema determiner 410 does not examine the complete comparison spectrum (e.g. the power spectrum 520) or does not examine the complete audio signal input spectrum. Instead, the extrema determiner 410 may only partially examine the comparison spectrum or the audio signal input spectrum.

Figure 6:
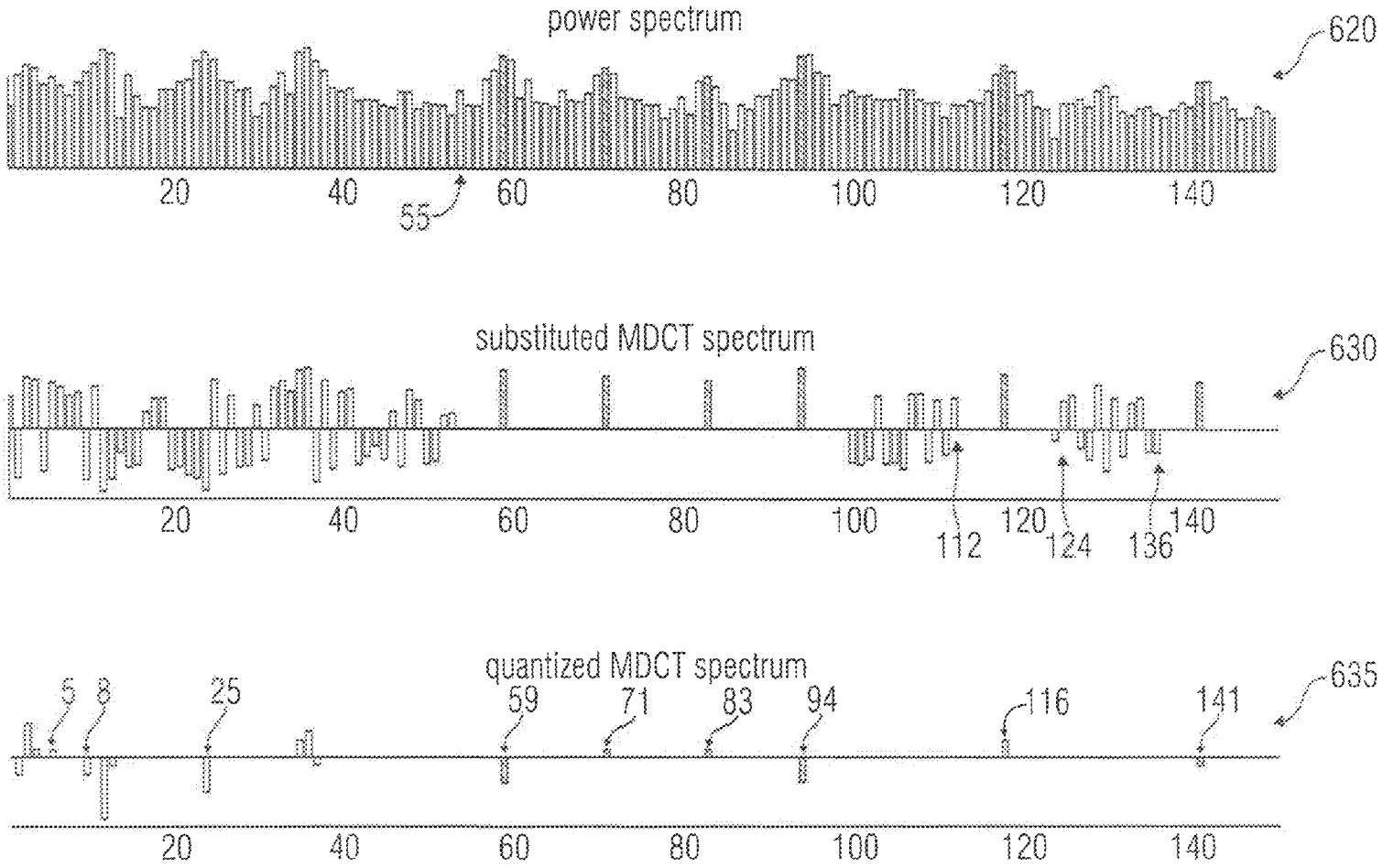
FIG. 6 illustrates another power spectrum, another modified (substituted) audio signal spectrum, and a quantized audio signal spectrum, wherein the quantized audio signal spectrum generated at an encoder side, may, in some embodiments, correspond to the decoded audio signal spectrum decoded at a decoding side.

FIG. 6 illustrates such an example. There, the power spectrum 620 (as a comparison spectrum) has been examined by an extrema determiner 410 starting at coefficient 55. The coefficients at spectral locations smaller than 55 have not been examined. Therefore, spectral coefficients at spectral locations smaller than 55 remain unmodified in the substituted MDCT spectrum 630. In contrast FIG. 5 illustrates a substituted MDCT spectrum 530 where all MDCT spectral lines have been modified by the spectrum modifier 420.

Thus, the spectrum modifier 420 may be configured to modify the audio signal input spectrum so that the spectral values of at least some of the spectral coefficients of the audio signal input spectrum are left unmodified.

In some embodiments, the spectrum modifier 420 is configured to determine, whether a value difference between one of the comparison value or the spectral value of one of the extremum coefficients is smaller than a threshold value. In such embodiments, the spectrum modifier 420 is configured to modify the audio signal input spectrum so that the spectral values of at least some of the spectral coefficients of the audio signal input spectrum are left unmodified in the modified audios signal spectrum depending on whether the value difference is smaller than the threshold value.

For example, in an embodiment, the spectrum modifier 420 may be configured not to modify or replace all, but instead modify or replace only some of the extremum coefficients. For example, when the difference between the comparison value of the extremum coefficient (e.g. a local maximum) and the comparison value of the subsequent and/or preceding minimum value is smaller than a threshold value, the spectrum modifier may be determined not to modify these spectral values (and e.g. the spectral values of spectral coefficients between them), but instead leave these spectral values unmodified in the modified (substituted) MDCT spectrum 630. In the modified MDCT spectrum 630 of FIG. 6, the spectral values of the spectral coefficients 100 to 112 and the spectral values of the spectral coefficients 124 to 136 have been left unmodified by the spectral modifier in the unmodified (substituted) spectrum 630.

The processing unit may furthermore be configured to quantize coefficients of the modified (substituted) MDCT spectrum 630 to obtain a quantized MDCT spectrum 635.

According to an embodiment, the spectrum modifier 420 may be configured to receive fine-tuning information. The spectral values of the spectral coefficients of the audio signal input spectrum may be signed values, each comprising a sign component. The spectrum modifier may be configured to set the sign component of one of the one or more extremum coefficients or of the pseudo coefficient to a first sign value, when the fine-tuning information is in a first fine-tuning state. And the spectrum modifier may be configured to set the sign component of the spectral value of one of the one or more extremum coefficients or of the pseudo coefficient to a different second sign value, when the fine-tuning information is in a different second fine-tuning state.

For example, in Table 4,

TABLE 4

| | Spectral Location | | | | | | | | |
|---|---|---|---|---|---|---|---|---|---|
| | 291 | 301 | 321 | 329 | 342 | 362 | 388 | 397 | 405 |
| Spectral Value | +0.88 | −0.91 | +0.79 | −0.82 | +0.93 | −0.92 | −0.90 | +0.95 | −0.92 |
| Fine-tuning state | 1st | 2nd | 1st | 2nd | 1st | 2nd | 2nd | 1st | 2nd |

the spectral values of the spectral coefficients indicate that spectral coefficient 291 is in a first fine-tuning state, spectral coefficient 301 is in a second fine-tuning state, spectral coefficient 321 is in the first fine-tuning state, etc.

For example, returning to the center-of-gravity determination explained above, if the center of gravity is (e.g. approximately in the middle) between two spectral locations, the spectral modifier may set the sign so that the second fine-tuning state is indicated.

According to an embodiment, the processing unit 430 may be configured to quantize the modified audio signal spectrum to obtain a quantized audio signal spectrum. The processing unit 430 may furthermore be configured to process the quantized audio signal spectrum to obtain an encoded audio signal spectrum.

Moreover, the processing unit 430 may furthermore be configured to generate side information indicating only for those spectral coefficients of the quantized audio signal spectrum which have an immediate predecessor the spectral value of which is equal to the predefined value and an immediate successor, the spectral value of which is equal to the predefined value, whether a said coefficient is one of the extremum coefficients.

Such information can be provided by the extrema determiner 410 to the processing unit 430.

For example, such an information may be stored by the processing unit 430 in a bit field, indicating for each of the spectral coefficients of the quantized audio signal spectrum which has an immediate predecessor the spectral value of which is equal to the predefined value and an immediate successor, the spectral value of which is equal to the predefined value, whether said coefficient is one of the extremum coefficients (e.g. by a bit value 1) or whether said coefficient is not one of the extremum coefficients (e.g. by a bit value 0). In an embodiment, a decoder can later on use this information for restoring the audio signal input spectrum. The bit field may have a fixed length or a signal adaptively chosen length. In the latter case, the length of the bit field might be additionally conveyed to the decoder.

For example, a bit field [000111111] generated by the processing unit 430 might indicate, that the first three "stand-alone" coefficients (their spectral value is not equal to the predefined value, but the spectral values of their predecessor and of their successor are equal to the predefined value) that appear in the (sequentially ordered) (quantized) audio signal spectrum are not extremum coefficients, but the next six "stand-alone" coefficients are extremum coefficients. This bit field describes the situation that can be seen in the quantized MDCT spectrum 635 in FIG. 6, where the first three "stand-alone" coefficients 5, 8, 25 are not extremum coefficients, but where the next six "stand-alone" coefficients 59, 71, 83, 94, 116, 141 are extremum coefficients.

Again, the immediate predecessor of said spectral coefficient is another spectral coefficient which immediately precedes said spectral coefficient within the quantized audio signal spectrum, and the immediate successor of said spectral coefficient is another spectral coefficient which immediately succeeds said spectral coefficient within the quantized audio signal spectrum.

In the following, an apparatus for generating an audio output signal based on an encoded audio signal spectrum according to an embodiment is described.

Figure 1:
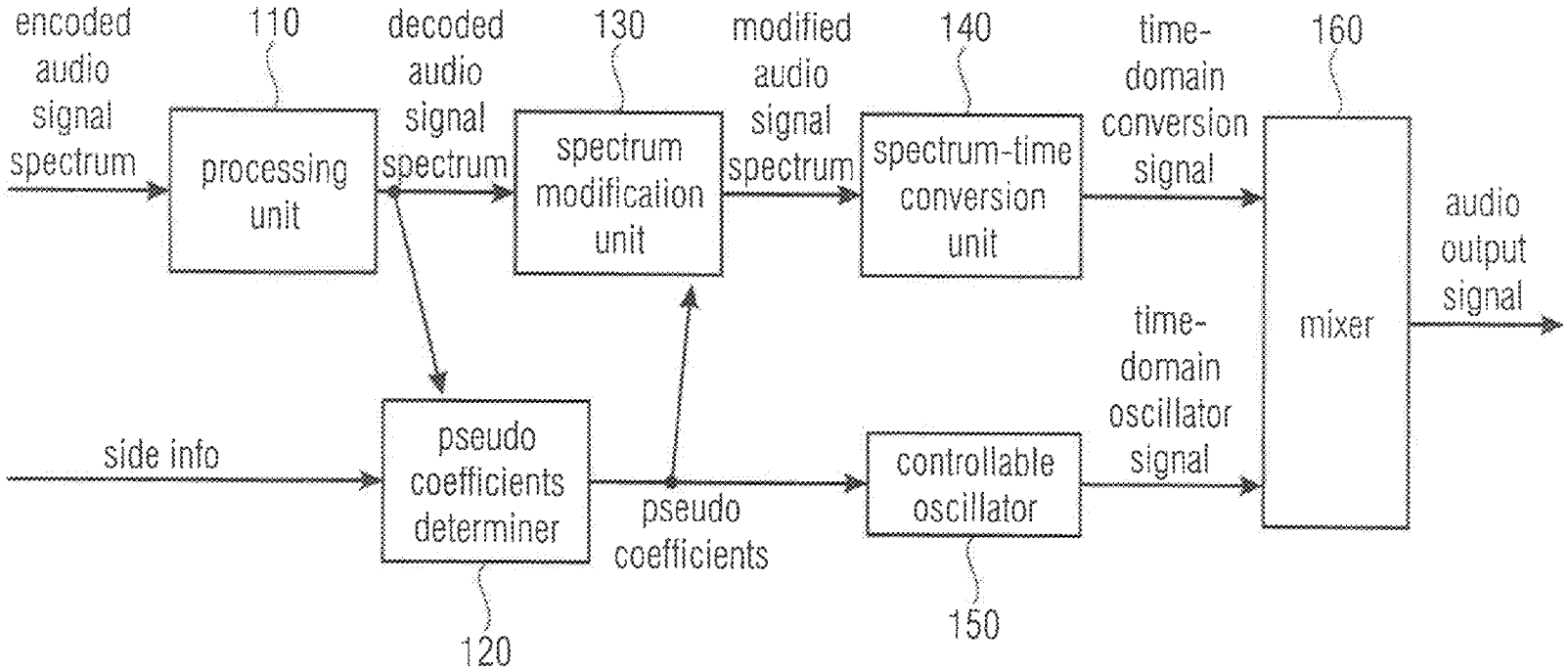
FIG. 1 illustrates an apparatus for generating an audio output signal based on an encoded audio signal spectrum according to an embodiment.

FIG. 1 illustrates such an apparatus for generating an audio output signal based on an encoded audio signal spectrum according to an embodiment.

The apparatus comprises a processing unit 110 for processing the encoded audio signal spectrum to obtain a decoded audio signal spectrum. The decoded audio signal spectrum comprises a plurality of spectral coefficients, wherein each of the spectral coefficients has a spectral location within the encoded audio signal spectrum and a spectral value, wherein the spectral coefficients are sequentially ordered according to their spectral location within the encoded audio signal spectrum so that the spectral coefficients form a sequence of spectral coefficients.

Moreover, the apparatus comprises a pseudo coefficients determiner 120 for determining one or more pseudo coefficients of the decoded audio signal spectrum using side information (side info), each of the pseudo coefficients having a spectral location and a spectral value.

Furthermore, the apparatus comprises a spectrum modification unit 130 for setting the one or more pseudo coefficients to a predefined value to obtain a modified audio signal spectrum.

Moreover, the apparatus comprises a spectrum-time conversion unit 140 for converting the modified audio signal spectrum to a time-domain to obtain a time-domain conversion signal.

Furthermore, the apparatus comprises a controllable oscillator 150 for generating a time-domain oscillator signal, the controllable oscillator being controlled by the spectral location and the spectral value of at least one of the one or more pseudo coefficients.

Moreover, the apparatus comprises a mixer 160 for mixing the time-domain conversion signal and the time-domain oscillator signal to obtain the audio output signal.

In an embodiment, the mixer may be configured to mix the time-domain conversion signal and the time-domain oscillator signal by adding the time-domain conversion signal to the time-domain oscillator signal in the time-domain.

The processing unit 110 may, for example, be any kind of audio decoder, for example, an MP3 audio decoder, an audio decoder for WMA, an audio decoder for WAVE-files, an AAC audio decoder or an USAC audio decoder.

The processing unit 110 may, for example, be an audio decoder as described in [8] (ISO/IEC 14496-3:2005—Information technology—Coding of audio-visual objects—Part 3: Audio, Subpart 4) or as described in [9] (ISO/IEC 14496-3: 2005—Information technology—Coding of audio-visual objects—Part 3: Audio, Subpart 4). For example, the processing unit 430 may comprise a rescaling of quantized values ("de-quantization"), and/or a temporal noise shaping tool, as, for example, described in [8] and/or the processing unit 430 may comprise a perceptual noise substitution tool, as, for example, described in [8].

According to an embodiment, each of the spectral coefficients may have at least one of an immediate predecessor and an immediate successor, wherein the immediate predecessor of said spectral coefficient may be one of the spectral coefficients that immediately precedes said spectral coefficient within the sequence, wherein the immediate successor of said spectral coefficient may be one of the spectral coefficients that immediately succeeds said spectral coefficient within the sequence.

The pseudo coefficients determiner 120 may be configured to determine the one or more pseudo coefficients of the decoded audio signal spectrum by determining at least one spectral coefficient of the sequence, which has a spectral value which is different from the predefined value, which has an immediate predecessor the spectral value of which is equal to the predefined value, and which has an immediate successor the spectral value of which is equal to the predefined value. In an embodiment, the predefined value may be zero and the predefined value may be zero.

In other words: The pseudo coefficients determiner 120 determines for some or all of the coefficients of the decoded audio signal spectrum whether the respectively considered coefficient is different from the predefined value (advantageously: different from 0), whether the spectral value of the preceding coefficient is equal to the predefined value (advantageously: equal to 0) and whether the spectral value of the succeeding coefficient is equal to the predefined value (advantageously: equal to 0).

In some embodiments, such a determined coefficient is (invariably) a pseudo coefficient.

In other embodiments, however, such a determined coefficient is (only) a pseudo coefficient candidate and may or may not be a pseudo coefficient. In those embodiments, the pseudo coefficients determiner 120 is configured to determine the at least one pseudo coefficient candidate, which has a spectral value which is different from the predefined value, which has an immediate predecessor, the spectral value of which is equal to the predefined value, and which may have an immediate successor, the spectral value of which is equal to the predefined value.

The pseudo coefficients determiner 120 is then configured to determine whether the pseudo coefficient candidate is a pseudo coefficient by determining whether side information indicates that said pseudo coefficient candidate is a pseudo coefficient.

For example, such side information may be received by the pseudo coefficients determiner 120 in a bit field, which indicates for each of the spectral coefficients of the quantized audio signal spectrum which has an immediate predecessor the spectral value of which is equal to the predefined value and an immediate successor, the spectral value of which is equal to the predefined value, whether said coefficient is one of the extremum coefficients (e.g. by a bit value 1) or whether said coefficient is not one of the extremum coefficients (e.g. by a bit value 0).

E.g., a bit field [000111111] might indicate, that the first three "stand-alone" coefficients (their spectral value is not equal to the predefined value, but the spectral values of their predecessor and of their successor are equal to the predefined value) that appear in the (sequentially ordered) (quantized) audio signal spectrum are not extremum coefficients, but the next six "stand-alone" coefficients are extremum coefficients. This bit field describes the situation that can be seen in the quantized MDCT spectrum 635 in FIG. 6, where the first three "stand-alone" coefficients 5, 8, 25 are not extremum coefficients, but where the next six "stand-alone" coefficients 59, 71, 83, 94, 116, 141 are extremum coefficients.

The spectrum modification unit 130 may be configured to "delete" the pseudo coefficients from the decoded audio signal spectrum. In fact, the spectrum modification unit sets the spectral value of the pseudo coefficients of the decoded audio signal spectrum to the predefined value (advantageously to 0). This is reasonable, as the (at least one) pseudo coefficients will only be needed to control the (at least one) controllable oscillator 150. Thus, consider, for example, the quantized MDCT spectrum 635 in FIG. 6. If the spectrum 635 is considered as the decoded audio signal spectrum, the spectrum modification unit 130 would set the spectral values of the extremum coefficients 59, 71, 83, 94, 116 and 141 to obtain the modified audio signal spectrum and would leave the other coefficients of the spectrum unmodified.

The spectrum-time conversion unit 140 converts the modified audio signal spectrum from a spectral domain to a time-domain. For example, the modified audio signal spectrum may be an MDCT spectrum, and the spectrum-time conversion unit 140 may be an Inverse Modified Discrete Cosine Transform (IMDCT) filter bank. In other embodiments, the spectrum may be an MDST spectrum and the spectrum-time conversion unit 140 may be an Inverse Modified Discrete Sine Transform (IMDST) filter bank. Or, in further embodiments, the spectrum may be a DFT spectrum and the spectrum-time conversion unit 140 may be an Inverse Discrete Fourier Transform (IDFT) filter bank.

The controllable oscillator 150 may be configured to generate the time-domain oscillator signal having a oscillator signal frequency so that the oscillator signal frequency of the oscillator signal may depend on the spectral location of one of the one or more pseudo coefficients. The oscillator signal generated by the oscillator may be a time-domain sine signal. The controllable oscillator 150 may be configured to control the amplitude of the time-domain sine signal depending on the spectral value of one of the one or more pseudo coefficients.

According to an embodiment, the pseudo coefficients are signed values, each comprising a sign component. The controllable oscillator 150 may be configured to generate the time-domain oscillator signal so that the oscillator signal frequency of the oscillator signal furthermore may depend on the sign component of one of the one or more pseudo coefficients so that the oscillator signal frequency may have a first frequency value, when the sign component has a first sign value, and so that the oscillator signal frequency may have a different second frequency value, when the sign component has a different second value.

For example, consider the pseudo coefficient at spectral location 59 in the MDCT spectrum 635 of FIG. 6. If frequency 8200 Hz would be assigned to spectral location 59 and if frequency 8400 Hz would be assigned to spectral location 60, then, the controllable oscillator may, for example, be configured set the oscillator frequency to 8200 Hz, if the sign of the of the spectral value of the pseudo coefficient is positive, and may, for example, be configured set the oscillator frequency to 8300 Hz, if the sign of the spectral value of the pseudo coefficient is negative.

Thus, the sign of the spectral value of the pseudo coefficient can be used to control, whether the controllable oscillator sets the oscillator frequency to a frequency (e.g. 8200 Hz) assigned to the spectral location of the pseudo coefficient (e.g. spectral location 59) or to a frequency (e.g. 8300 Hz) between the frequency (e.g. 8200 Hz) assigned to the spectral location of the pseudo coefficient (e.g. spectral location 59) and the frequency (e.g. 8400 Hz) assigned to the spectral location that immediately follows the spectral location of the pseudo coefficient (e.g. spectral location 60).

In an embodiment, the controllable oscillator 150 is additionally controlled by one or more extrapolated parameters derived from a pseudo coefficient of a preceding frame. For example, the controllable oscillator 150 may also be additionally controlled through extrapolated parameters derived from the pseudo coefficient of the preceding frame in order to e.g. conceal a data frame loss during transmission, or to smooth an unstable behaviour of the oscillator control. An extrapolated parameters may, for example, be a spectral location or a spectral value. For example, when spectral coefficients of a time-frequency domain are considered, the spectral coefficients relating to time-instant t-1 may be comprised by a first frame, and the spectral coefficients relating to time-instant t may be assigned to a second frame. E.g. the spectral value and/or the spectral location of a pseudo coefficient relating to time-instant t-1 may be copied to obtain an extrapolated parameter for a current frame relating to time-instant t.

Figure 2:
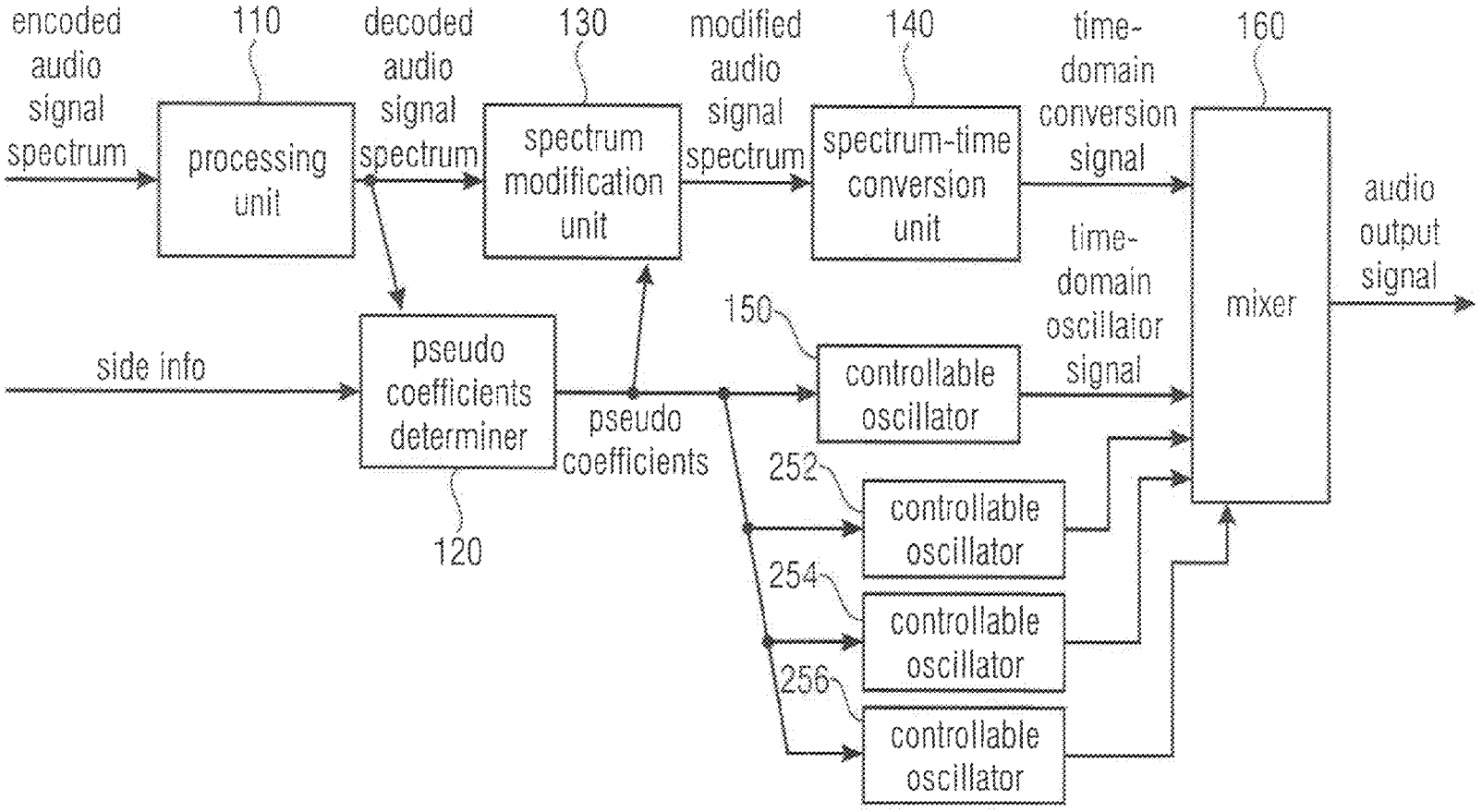
FIG. 2 depicts an apparatus for generating an audio output signal based on an encoded audio signal spectrum according to another embodiment.

FIG. 2 illustrates an embodiment, wherein the apparatus comprises further controllable oscillators 252, 254, 256 for generating further time-domain oscillator signals controlled by the spectral locations and the spectral values of further pseudo coefficients of the one or more pseudo coefficients.

The further controllable oscillators 252, 254, 256 each generate one of the further time-domain oscillator signals. Each of the controllable oscillators 252, 254, 256 is configured to steer the oscillator signal frequency based on the spectral location of one of the pseudo coefficients. And/or each of the controllable oscillators 252, 254, 256 is configured to steer the amplitude of the oscillator signal based on the spectral value of one of the pseudo coefficients.

The mixer 160 of FIG. 1 and FIG. 2 is configured to mix the time-domain conversion signal generated by the spectrum-time conversion unit 140 and the one or more time-domain oscillator signal generated by the one or more controllable oscillators 150, 252, 254, 256 to obtain the audio output signal. The mixer 160 may generate the audio output signal by a superposition of the time-domain conversion signal and the one or more time-domain oscillator signals.

Figure 3:
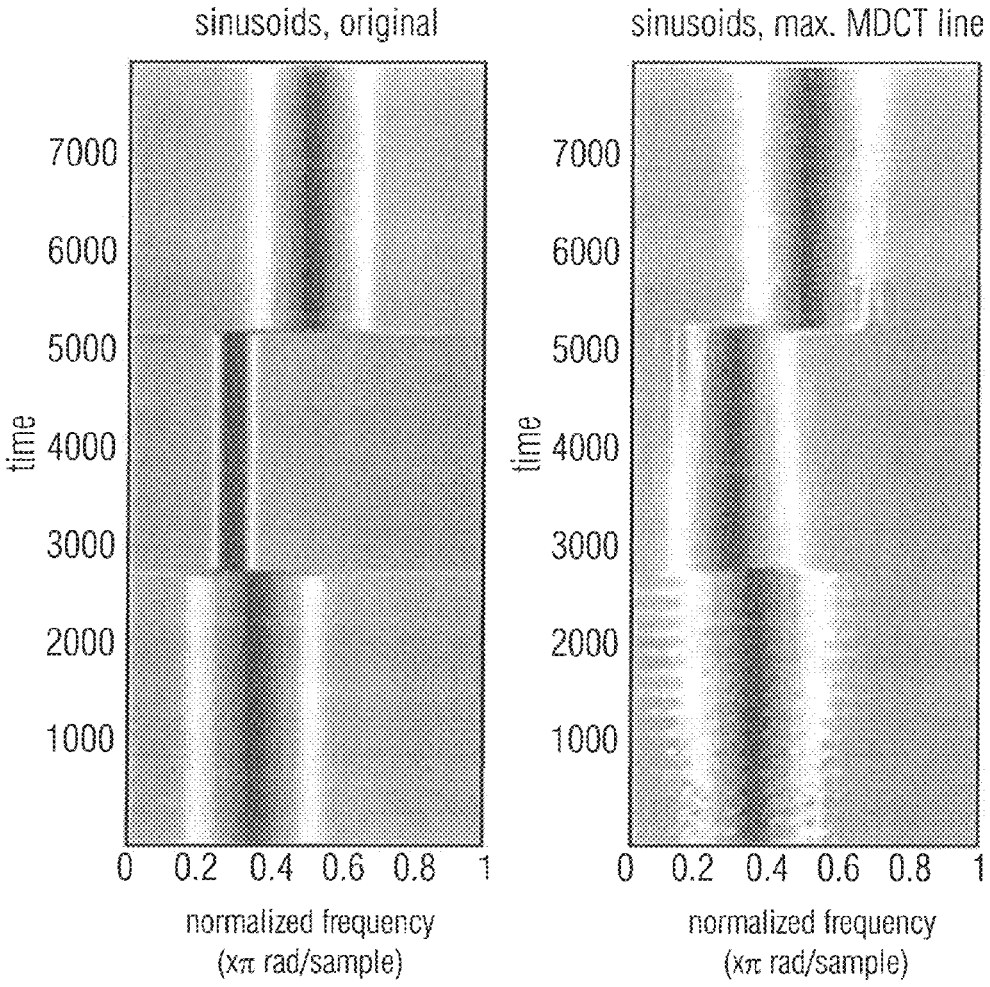
FIG. 3 shows two diagrams comparing original sinusoids and sinusoids after processed by an MDCT/inverse MDCT chain.

FIG. 3 illustrates two diagrams comparing original sinusoids (left) and sinusoids after processed by an MDCT/IMDCT chain (right). After being processed by the MDCT/IMDCT chain, the sinusoid comprises warbling artifacts. The concepts provided above avoid that sinusoids are processed by the MDCT/IMDCT chain, but instead, sinusoidal information is encoded by a pseudo coefficient and/or the sinusoid is reproduced by a controllable oscillator.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

The inventive decomposed signal can be stored on a digital storage medium or can be transmitted on a transmission medium such as a wireless transmission medium or a wired transmission medium such as the Internet.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are advantageously performed by any hardware apparatus.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

References

[1] Daudet, L.; Sandler, M.; "MDCT analysis of sinusoids: exact results and applications to coding artifacts reduction," Speech and Audio Processing, IEEE Transactions on, vol. 12, no. 3, pp. 302-312, May 2004

[2] Purnhagen, H.; Meine, N.; "HILN-the MPEG-4 parametric audio coding tools," *Circuits and Systems,* 2000. *Proceedings. ISCAS* 2000 *Geneva. The* 2000 *IEEE International Symposium an*, vol. 3, no., pp. 201-204 vol. 3, 2000

[3] Oomen, Werner; Schuijers, Erik; den Brinker, Bert; Breebaart, Jeroen: "Advances in Parametrie Coding for High-Quality Audio," Audio Engineering Society Convention 114, preprint, Amsterdam/NL, Mar. 2003

[4] van Schijndel, N. H.; van de Par, S.; "Rate-distortion optimized hybrid sound coding," Applications of Signal Processing to Audio and Acoustics, 2005. IEEE Workshop on, vol., no., pp. 235-238, 16-19 Oct. 2005

[5] Bessette, 8.; Lefebvre, R.; Salami, R.; "Universal speech/audio coding using hybrid ACELP/TCX techniques," Acoustics, Speech, and Signal Processing, 2005. Proceedings. (ICASSP '05). IEEE International Conference on, vol. 3, no., pp. iii/301-iii/304 Val. 3, 18-23 Mar. 2005

[6] Ferreira, A. J. S. "Combined spectral envelope normalization and subtraction of sinusoidal components in the ODFT and MDCT frequency domains," Applications of Signal Processing to Audio and Acoustics, 2001 IEEE Workshop on the, vol., no., pp. 51-54, 2001

[7] http://people.xiph.org/~xiphmont/demo/ghost/demo.html The corresponding archive.org-website is stored at: http://web.archive.org/web/20110121141149/http://people.xiph.org/~xiphmont/demo/ghost/demo.html

[8] ISO/IEC 14496-3:2005(E)—Information technology—Coding of audio-visual objects—Part 3: Audio, Subpart 4

[9] ISO/IEC 14496-3:2009(E)—Information technology—Coding of audio-visual objects—Part 3: Audio, Subpart 4

The invention claimed is:

1. An apparatus for generating an audio output signal based on an encoded audio signal spectrum, wherein the apparatus comprises:

a processing unit for processing the encoded audio signal spectrum to acquire a decoded audio signal spectrum the decoded audio signal spectrum comprising a plurality of spectral coefficients, wherein each of the spectral coefficients comprises a spectral location within the encoded audio signal spectrum and a spectral value, wherein the spectral coefficients are sequentially ordered according to their spectral location within the encoded audio signal spectrum so that the spectral coefficients form a sequence of spectral coefficients, a pseudo coefficients determiner for determining one or more pseudo coefficients of the decoded audio signal spectrum, each of the pseudo coefficients comprising a spectral location and a spectral value, a spectrum modification unit for setting the one or more pseudo coefficients to a predefined value to acquire a modified audio signal spectrum, a spectrum-time conversion unit for converting the modified audio signal spectrum to a time-domain to acquire a time-domain conversion signal, a controllable oscillator for generating a time-domain oscillator signal, the controllable oscillator being controlled by the spectral location and the spectral value of at least one of the one or more pseudo coefficients, and a mixer for mixing the time-domain conversion signal and the time-domain oscillator signal to acquire the audio output signal, wherein at least one of the processing unit, the pseudo coefficients determiner, the spectrum modification unit, the spectrum-time conversion unit, the controllable oscillator and the mixer comprises a hardware implementation.

2. The apparatus according to claim 1, wherein each of the spectral coefficients comprises at least one of an immediate predecessor and an immediate successor, wherein the immediate predecessor of said spectral coefficient is one of the spectral coefficients that immediately precedes said spectral coefficient within the sequence of spectral coefficients, wherein the immediate successor of said spectral coefficient is one of the spectral coefficients that immediately succeeds said spectral coefficient within the sequence, wherein the pseudo coefficients determiner is configured to determine the one or more pseudo coefficients of the decoded audio signal spectrum by determining at least one spectral coefficient of the sequence which comprises a spectral value which is different from the predefined value, which comprises an immediate predecessor the spectral value of which is equal to the predefined value, and which comprises an immediate successor the spectral value of which is equal to the predefined value.

3. The apparatus according to claim 2, wherein the predefined value is zero.

4. The apparatus according to claim 2, wherein the pseudo coefficients determiner is configured to determine the one or more pseudo coefficients of the decoded audio signal spectrum by determining the at least one spectral coefficient of the sequence as a pseudo coefficient candidate, which comprises an immediate predecessor, the spectral value of which is equal to the predefined value, and which comprises an immediate successor, the spectral value of which is equal to the predefined value, and wherein the pseudo coefficients determiner is configured to determine whether the pseudo coefficient candidate is a pseudo coefficient by determining whether side information indicates that said pseudo coefficient candidate is a pseudo coefficient.

5. The apparatus according to claim 1, wherein the controllable oscillator is configured to generate the time-domain oscillator signal comprising a oscillator signal frequency so that the oscillator signal frequency of the oscillator signal depends on the spectral location of one of the one or more pseudo coefficients.

6. The apparatus according to claim 5, wherein the pseudo coefficients are signed values, each comprising a sign component, and wherein the controllable oscillator is configured to generate the time-domain oscillator signal so that the oscillator signal frequency of the oscillator signal furthermore depends on the sign component of one of the one or more pseudo coefficients so that the oscillator signal frequency comprises a first frequency value, when the sign component comprises a first sign value, and so that the oscillator signal frequency comprises a different second frequency value, when the sign component comprises a different second value.

7. The apparatus according to claim 1, wherein the controllable oscillator is configured to generate the time-domain oscillator signal, wherein the amplitude of the oscillator signal depends on the spectral value of one of the one or more pseudo coefficients, so that the amplitude of the oscillator signal comprises a first amplitude value when the spectral value comprises a third value, and so that that the amplitude of the oscillator signal comprises a different second amplitude value when the spectral value comprises a different fourth value, the second amplitude value being greater than the first amplitude value, when the fourth value is greater than the third value.

8. The apparatus according to claim 1, wherein the controllable oscillator is additionally controlled by one or more extrapolated parameters derived from a pseudo coefficient of a preceding frame.

9. The apparatus according to claim 1, wherein the modified audio signal spectrum is an MDCT spectrum, comprising MDCT coefficients, and wherein the spectrum-time conversion unit is configured to convert the MDCT spectrum from an MDCT domain to the time domain by converting at least some of the coefficients of the decoded audio signal spectrum to the time domain.

10. The apparatus according to claim 1, wherein the mixer is configured to mix the time-domain conversion signal and the time-domain oscillator signal by adding the time-domain conversion signal to the time-domain oscillator signal in the time-domain.

11. The apparatus according to claim 1, wherein the time-domain oscillator signal generated by the controllable oscillator is a first time-domain oscillator signal, wherein the apparatus furthermore comprises one or more further controllable oscillators for generating one or more further time-domain oscillator signals, wherein each of the one or more further controllable oscillators is configured to generate one of the one or more further time-domain oscillator signals, wherein each of the further controllable oscillators is controlled by the spectral location and the spectral value of at least one of the one or more pseudo coefficients, and wherein the mixer is configured to mix the first time-domain oscillator signal, the one or more further time-domain oscillator signals, and the time-domain conversion signal to acquire the audio output signal.

12. An apparatus for encoding an audio signal input spectrum of an audio signal, the audio signal input spectrum comprising a plurality of spectral coefficients, wherein each of the spectral coefficients comprises a spectral location within the audio signal input spectrum, a spectral value, wherein the spectral coefficients are sequentially ordered according to their spectral location within the audio signal input spectrum so that the spectral coefficients form a sequence of spectral coefficients, wherein each of the spectral coefficients comprises at least one of one or more predecessors and one or more successors, wherein the each of the predecessors of said spectral coefficient is one of the spectral coefficients that precedes said spectral coefficient within the sequence, wherein each of the successors of said spectral coefficient is one of the spectral coefficients that succeeds said spectral coefficient within the sequence, and wherein the apparatus comprises:

an extrema determiner for determining one or more extremum coefficients, a spectrum modifier for modifying the audio signal input spectrum to acquire a modified audio signal spectrum by setting the spectral value of at least one of the predecessors or at least one of the successors of at least one of the extremum coefficients to a predefined value, wherein the spectrum modifier is configured to not set the spectral values of the one or more extremum coefficients to the predefined value, or is configured to replace at least one of the one or more extremum coefficients by a pseudo coefficient, wherein the spectral value of the pseudo coefficient is different from the predefined value, a processing unit for processing the modified audio signal spectrum to acquire an encoded audio signal spectrum, and a side information generator for generating and transmitting side information, wherein the side information generator is configured to locate one or more pseudo coefficient candidates within the modified audio signal input spectrum generated by the spectrum modifier, wherein the side information generator is configured to select at least one of the pseudo coefficient candidates as selected candidates, and wherein the side information generator is configured to generate the side information so that the side information indicates the selected candidates as the pseudo coefficients, wherein the extrema determiner is configured to determine the one or more extremum coefficients, so that each of the extremum coefficients is one of the spectral coefficients the spectral value of which is greater than the spectral value of at least one of its predecessors and the spectral value of which is greater than the spectral value of at least one of its successors, or wherein each of the spectral coefficients comprises a comparison value associated with said spectral coefficient, wherein the extrema determiner is configured to determine the one or more extremum coefficients, so that each of the extremum coefficients is one of the spectral coefficients the comparison value of which is greater than the comparison value of at least one of its predecessors and the comparison value of which is greater than the comparison value of at least one of its successors, wherein at least one of the extrema determiner, the spectrum modifier, the processing unit and the side information generator comprises a hardware implementation.

13. The apparatus according to claim 12, wherein the side information generator is configured to transmit the size of the side information.

14. The apparatus according to claim 12, wherein the spectrum modifier is configured to modify the audio signal input spectrum so that the spectral values of at least some of the spectral coefficients of the audio signal input spectrum are left unmodified in the modified audio signal spectrum.

15. The apparatus according to claim 12, wherein each of the spectral coefficients comprises at least one of an immediate predecessor as one of its predecessors and an immediate successor as one of its successors, wherein the immediate predecessor of said spectral coefficient is one of the spectral coefficients that immediately precedes said spectral coefficient within the sequence, wherein the immediate successor of said spectral coefficient is one of the spectral coefficients that immediately succeeds said spectral coefficient within the sequence, wherein the spectrum modifier is configured to modify the audio signal input spectrum to acquire the modified audio signal spectrum by setting the spectral value of the immediate predecessor or the immediate successor of at least one of the extremum coefficients to the predefined value, wherein the spectrum modifier is configured to not set the spectral values of the one or more extremum coefficients to the predefined value, or is configured to replace at least one of the one or more extremum coefficients by a pseudo coefficient, wherein the spectral value of the pseudo coefficient is different from the predefined value, and wherein the extrema determiner is configured to determine the one or more extremum coefficients, so that each of the extremum coefficients is one of the spectral coefficients the spectral value of which is greater than the spectral value of its immediate predecessor and the spectral value of which is greater than the spectral value of its immediate successor, or wherein each of the spectral coefficients comprises a comparison value associated with said spectral coefficient, wherein the extrema determiner is configured to determine the one or more extremum coefficients, so that each of the extremum coefficients is one of the spectral coefficients the comparison value of which is greater than the comparison value of its immediate predecessor and the comparison value of which is greater than the comparison value of its immediate successor.

16. The apparatus according to claim 15, wherein the extrema determiner is configured to determine one or more minimum coefficients, so that each of the one or more minimum coefficients is one of the spectral coefficients the spectral value of which is smaller than the spectral value of one of its predecessors and the spectral value of which is smaller than the spectral value of one of its successors, or wherein each of the spectral coefficients comprises a comparison value associated with said spectral coefficient, wherein the extrema determiner is configured to determine the one or more minimum coefficients, so that each of the minimum coefficients is one of the spectral coefficients the comparison value of which is smaller than the comparison value of one of its predecessors and the comparison value of which is smaller than the comparison value of one of its successors, and wherein the spectrum modifier is configured to determine a representation value based on the spectral values or the comparison values of one or more of the extremum coefficients and one or more of the minimum coefficients, so that the representation value is different from the predefined value, and wherein the spectrum modifier is configured to change the spectral value of one of the coefficients of the audio signal input spectrum by setting said spectral value to the representation value.

17. The apparatus according to claim 16, wherein spectrum modifier is configured to determine, whether a value difference between one of the comparison value or the spectral value of one of the extremum coefficients is smaller than a threshold value, and wherein the spectrum modifier is configured to modify the audio signal input spectrum so that the spectral values of at least some of the spectral coefficients of the audio signal input spectrum are left unmodified in the modified audio signal spectrum depending on whether the value difference is smaller than the threshold value.

18. The apparatus according to claim 16, wherein the extrema determiner is configured to determine one or more sub-sequences of the sequence of spectral values, so that each one of the sub-sequences comprises a plurality of subsequent spectral coefficients the audio signal input spectrum, the subsequent spectral coefficients being sequentially ordered within the sub-sequence according to their spectral position, wherein each of the sub-sequences comprises a first element being first in said sequentially-ordered sub-sequence and a last element being last in said sequentially-ordered sub-sequence, wherein each of the sub-sequences comprises exactly two of the minimum coefficients and exactly one of the extremum coefficients, one of the minimum coefficients being the first element of the sub-sequence, the other one of the minimum coefficients being the last element of the sub-sequence, and wherein the spectrum modifier is configured to determine the representation value based on the spectral values or the comparison values of the coefficients of one of the sub-sequences, and wherein the spectrum modifier is configured to change the spectral value of one of the coefficients of said sub-sequence by setting said spectral value to the representation value.

19. The apparatus according to claim 18, wherein the spectrum modifier is configured to determine the representation value by determining a sum of the squares of the comparison values of the coefficients of said one of the sub-sequences.

20. The apparatus according to claim 18, wherein the extrema determiner is configured to determine a center-of-gravity coefficient by determining the product of the comparison value and the location value for each spectral coefficient of the sub-sequence to acquire a plurality of weighted coefficients, by summing up the weighted coefficients to acquire a first sum, summing up the comparison values of all spectral coefficients of the sub-sequence to acquire a second sum; by dividing the first sum by the second sum to acquire an intermediate result; and by applying round-to-nearest rounding on the intermediate result to acquire the center-of-gravity coefficient, and wherein the spectrum modifier is configured to set the spectral values of all spectral coefficients of the sub-sequence, which are not the center-of-gravity coefficient to the predefined value, or wherein the extrema determiner is configured to determine a center-of-gravity coefficient by determining the product of the spectral value and the location value for each spectral coefficient of the sub-sequence to acquire a plurality of weighted coefficients, by summing up the weighted coefficients to acquire a first sum, summing up the spectral values of all spectral coefficients of the sub-sequence to acquire a second sum; by dividing the first sum by the second sum to acquire an intermediate result; and by applying round-to-nearest rounding on the intermediate result to acquire the center-of-gravity coefficient, and wherein the spectrum modifier is configured to set the spectral values of all spectral coefficients of the sub-sequence, which are not the center-of-gravity coefficient to the predefined value.

21. The apparatus according to claim 12, wherein the predefined value is zero.

22. The apparatus according to claim 12, wherein the comparison value of each spectral coefficient is a square value of a further coefficient of a further spectrum resulting from an energy preserving transformation of the audio signal.

23. The apparatus according to claim 12, wherein the comparison value of each spectral coefficient is an amplitude value of a further coefficient of a further spectrum resulting from an energy preserving transformation of the audio signal.

24. The apparatus according to claim 12, wherein the further spectrum is a Complex Modified Discrete Cosine Transform spectrum, and wherein the energy preserving transformation is a Complex Modified Discrete Cosine Transform.

25. The apparatus according to claim 12, wherein the spectrum modifier is configured to receive fine-tuning information, wherein the spectral coefficients of the audio signal input spectrum are signed values, each comprising a sign component, wherein the spectrum modifier is configured to set the sign component of the spectral value of one of the one or more extremum coefficients or of the pseudo coefficient to a first sign value, when the fine-tuning information is in a first fine-tuning state to acquire the modified audio signal spectrum, and wherein the spectrum modifier is configured to set the sign component of the spectral value of one of the one or more extremum coefficients or of the pseudo coefficient to a different second sign value, when the fine-tuning information is in a different second fine-tuning state to acquire the modified audio signal spectrum.

26. The apparatus according to claim 12, wherein the audio signal input spectrum is an MDCT spectrum comprising MDCT coefficients.

27. The apparatus according to claim 12, wherein the processing unit is configured to quantize the modified audio signal spectrum to acquire a quantized audio signal spectrum, wherein the processing unit is furthermore configured to process the quantized audio signal spectrum to acquire an encoded audio signal spectrum, wherein the processing unit is furthermore configured to generate side information indicating only for those spectral coefficients of the quantized audio signal spectrum which comprise an immediate predecessor the spectral value of which is equal to the predefined value and an immediate successor, the spectral value of which is equal to the predefined value, whether said coefficient is one of the extremum coefficients, wherein the immediate predecessor of said spectral coefficient is another spectral coefficient which immediately precedes said spectral coefficient within the quantized audio signal spectrum, and wherein the immediate successor of said spectral coefficient is another spectral coefficient which immediately succeeds said spectral coefficient within the quantized audio signal spectrum.

28. The apparatus according to claim 12, wherein the spectrum modifier is configured to replace one of the extremum coefficients by a pseudo coefficient comprising a spectral value derived from the spectral value or the comparison value of said extremum coefficient, from the spectral value or the comparison value of said extremum coefficient of one of the predecessors of said extremum coefficient or from the spectral value or the comparison value of said extremum coefficient of one of the successors of said extremum coefficient.

29. A method for generating an audio output signal based on an encoded audio signal spectrum, wherein each of the spectral coefficients comprises a spectral location within the encoded audio signal spectrum and a spectral value, wherein the spectral coefficients are sequentially ordered according to their spectral location within the encoded audio signal spectrum so that the spectral coefficients form a sequence of spectral coefficients, and wherein the method comprises:

processing the encoded audio signal spectrum to acquire a decoded audio signal spectrum the decoded audio signal spectrum comprising a plurality of spectral coefficients, determining one or more pseudo coefficients of the decoded audio signal spectrum, each of the pseudo coefficients comprising a spectral location and a spectral value, setting the one or more pseudo coefficients to a predefined value to acquire a modified audio signal spectrum, converting the modified audio signal spectrum to a time-domain to acquire a time-domain conversion signal, generating a time-domain oscillator signal by a controllable oscillator being controlled by the spectral location and the spectral value of at least one of the one or more pseudo coefficients, and mixing the time-domain conversion signal and the time-domain oscillator signal to acquire the audio output signal, wherein the method is implemented using a hardware implementation.

30. A non-transitory computer-readable medium comprising a computer program for implementing the method of claim 29 when being executed on a computer or signal processor.

31. A method for encoding an audio signal input spectrum, the audio signal input spectrum comprising a plurality of spectral coefficients, wherein each of the spectral coefficients comprises a spectral location within the audio signal input spectrum, a spectral value and a comparison value, wherein the spectral coefficients are sequentially ordered according to their spectral location within the audio signal input spectrum so that the spectral coefficients form a sequence of spectral coefficients, wherein each of the spectral coefficients comprises at least one of one or more predecessors and one or more successors, wherein each one of the predecessors of said spectral coefficient is one of the spectral coefficients that precedes said spectral coefficient within the sequence, wherein each one of the successors of said spectral coefficient is one of the spectral coefficients that succeeds said spectral coefficient within the sequence, and wherein the method comprises:

determining one or more extremum coefficients, modifying the audio signal input spectrum to acquire a modified audio signal spectrum by setting the spectral value of at least one of the predecessors or at least one of the successors of at least one of the extremum coefficients to a predefined value, wherein modifying the audio signal input spectrum is conducted by not setting the spectral values of the one or more extremum coefficients to the predefined value, or by replacing at least one of the one or more extremum coefficients by a pseudo coefficient, wherein the spectral value of the pseudo coefficient is different from the predefined value, processing the modified audio signal spectrum to acquire an encoded audio signal spectrum, and generating and transmitting side information, wherein the side information is generated by locating one or more pseudo coefficient candidates within the modified audio signal input spectrum, wherein the side information is generated by selecting at least one of the pseudo coefficient candidates as selected candidates, and wherein the side information is generated so that the side information indicates the selected candidates as the pseudo coefficients, wherein the one or more extremum coefficients are determined, so that each of the extremum coefficients is one of the spectral coefficients the spectral value of which is greater than the spectral value of at least one of its predecessors and the spectral value of which is greater than the spectral value of at least one of its successors, or wherein each of the spectral coefficients comprises a comparison value associated with said spectral coefficient, wherein the one or more extremum coefficients are determined, so that each of the extremum coefficients is one of the spectral coefficients the comparison value of which is greater than the comparison value of at least one of its predecessors and the comparison value of which is greater than the comparison value of at least one of its successors, wherein the method is implemented using a hardware implementation.

32. A non-transitory computer-readable medium comprising a computer program for implementing the method of claim 31 when being executed on a computer or signal processor.

* * * * *